US009455505B2

(12) United States Patent
Buettner et al.

(10) Patent No.: US 9,455,505 B2
(45) Date of Patent: Sep. 27, 2016

(54) CONNECTION DEVICE, IN PARTICULAR SWITCHING DEVICE, COMPRISING A SPRING-TYPE TERMINAL AND A DRIVE FOR ACTUATING THE SPRING-TYPE TERMINAL

(71) Applicant: Wöhner GmbH & Co. KG Elektrotechnische Systeme, Roedental (DE)

(72) Inventors: Alex Buettner, Roedental (DE); Philipp Steinberger, Roedental (DE); Joram Masel, Kronach (DE)

(73) Assignee: Woehner GmbH & Co. KG, Roedental (DE)

( * ) Notice: Subject to any disclaimer, the term of this patent is extended or adjusted under 35 U.S.C. 154(b) by 45 days.

(21) Appl. No.: 14/305,989

(22) Filed: Jun. 16, 2014

(65) Prior Publication Data

US 2015/0004821 A1 Jan. 1, 2015

(30) Foreign Application Priority Data

Jun. 27, 2013 (DE) ..... 10 2013 212 438

(51) Int. Cl.
*H01R 4/48* (2006.01)
*H01R 13/629* (2006.01)

(52) U.S. Cl.
CPC ..... *H01R 4/489* (2013.01); *H01R 4/4836* (2013.01); *H01R 4/4845* (2013.01); *H01R 13/629* (2013.01)

(58) Field of Classification Search
CPC ..... H01R 4/4845
USPC ..... 439/828, 829, 835
See application file for complete search history.

(56) References Cited

U.S. PATENT DOCUMENTS

| | | | | |
|---|---|---|---|---|
| 6,689,955 | B2 * | 2/2004 | Doutaz | H01R 4/4836 174/135 |
| 8,651,890 | B2 * | 2/2014 | Chiarelli | H01R 4/4836 439/370 |
| 2003/0066673 | A1 | 4/2003 | Doutaz | |

FOREIGN PATENT DOCUMENTS

| | | | |
|---|---|---|---|
| CN | 101183750 | A | 5/2008 |
| CN | 102195145 | A | 9/2011 |
| CN | 102394387 | A | 3/2012 |
| DE | 43 32 969 | C1 | 7/1994 |
| DE | 100 37 550 | A1 | 2/2002 |
| DE | 203 15 605 | U1 | 3/2004 |

OTHER PUBLICATIONS

European Search Report corresponding to European Application No. 14172317.1 dated Jan. 8, 2014 (7 pages).
Chinese Office Action corresponding to Appl. No. 201410299275.X, date issued, Dec. 31, 2015 (10 pages).

* cited by examiner

*Primary Examiner* — Phuong Dinh
(74) *Attorney, Agent, or Firm* — Maginot, Moore & Beck, LLP

(57) ABSTRACT

Connection device for connecting at least one electrical conductor to at least one spring-type terminal which is provided in a housing of the connection device and which comprises a mechanical drive, the mechanical drive being arranged or installed in the housing and comprising a blade which has a broad face and a narrow face for actuating the spring-type terminal, the broad face of the blade moving the spring-type terminal into an open position in which the electrical conductor can be inserted into an insertion opening of the spring-type terminal.

14 Claims, 18 Drawing Sheets

CONNECTION DEVICE, IN PARTICULAR SWITCHING DEVICE, COMPRISING A SPRING-TYPE TERMINAL AND A DRIVE FOR ACTUATING THE SPRING-TYPE TERMINAL

The invention relates to a connection device, in particular a switching device for a busbar system, comprising at least one spring-type terminal and an associated drive for actuating the spring-type terminal.

Busbar systems are widespread and make it possible to mount switching devices directly on the rail during installation. The sizing of the busbar is primarily dependent on the current load. The cross-section of a busbar or current bar also depends on the mechanical loads and the type of connected equipment, as well as on the current load. In switching systems, a plurality of busbars may be laid in parallel. The busbars are generally made of aluminium or copper and are generally uninsulated, simplifying the mounting of connection and switching elements.

Conventional multi-pole switching devices may serve to connect electrical devices to the busbar system and protect them from overload, for example in that an electric fuse for protecting the electrical device is interposed. This component can be replaced by an assembler or installer as required.

There must not be any risk to an operator in disconnecting the power and changing the fuses.

In switching devices of this type, spring-type terminals are used to connect an electrical device to an electrical means of the switching device, for example an electric fuse.

To open the spring-type terminals, an installer conventionally uses a screwdriver, by means of which the levers open the spring-type terminal using a tilting movement. However, it is difficult to connect an electrical conductor to the spring-type terminal in this context, since the electrical conductor has to be supplied to the spring-type terminal and the spring-type terminal has to be levered open simultaneously using the screwdriver.

An object of the invention is therefore a connection device having improved actuation of the spring-type terminal for connecting an electrical conductor.

This object is achieved according to the invention by a connection device having the features specified in claim 1 and a method having the features specified in claim 15.

Accordingly, the invention provides a connection device for connecting at least one electrical conductor to at least one spring-type terminal which is provided in a housing of the connection device and which comprises a mechanical drive, the mechanical drive being arranged or installed in the housing and comprising a blade which has a broad face and a narrow face for actuating the spring-type terminal, the broad face of the blade moving the spring-type terminal into an open position in which the electrical conductor can be inserted into an insertion opening of the spring-type terminal.

By means of the drive installed in the housing, the spring-type terminal can be actuated more easily, since no screwdriver has to be applied to the spring-type terminal and lever it open so as simultaneously to connect an electrical conductor to the spring-type terminal. Further, by way of the blade for actuating the spring-type terminal, the drive has a simple construction which is cost-effective and simple to manufacture.

In one possible embodiment of the connection device according to the invention, the narrow face of the blade makes it possible to move the spring-type terminal into a closed position in which the electrical conductor is gripped in place in the spring-type terminal. By means of the broad and narrow faces of the blade, the spring-type terminal can very easily be brought into the open and closed positions thereof.

In a further possible embodiment of the connection device according to the invention, the spring-type terminal comprises a supporting leg and a spring leg, which has an introduction opening for introducing the electrical conductor and is pressed towards the supporting leg by the broad face of the blade of the mechanical drive so as to grip the introduced electrical conductor in place.

In one possible embodiment of the invention, the spring leg of the spring-type terminal may spring back into a closed position in which the electrical conductor is gripped in the spring-type terminal when the narrow face of the blade is brought into contact with the spring leg or the broad face of the blade is removed from the spring leg. This spring-back of the spring-type terminal makes it possible for the spring-type terminal to snap across automatically into the closed position thereof, without the spring-type terminal having to be moved into the closed position thereof by an installer or assembler.

In a further possible embodiment of the connection device according to the invention, the mechanical drive comprises a tool seat on one end, for example a slit, for receiving a tool and actuating the spring-type terminal by means of the mechanical drive. By means of the tool received in the tool seat, the mechanical drive can be actuated very easily, as can the spring-type terminal by way of said drive. Moreover, a tool seat of this type is simple and cost-effective to manufacture.

In another possible embodiment of the connection device according to the invention, the mechanical drive comprises an actuation element on one end for actuating the mechanical drive. The actuation element is for example a handle, lever or switch for rotating the mechanical drive in the peripheral direction. In this context, there is no need to use a tool, such as a screwdriver, in order to rotate the mechanical drive.

In a further possible embodiment of the connection device according to the invention, at least one projection is formed on the mechanical drive for actuating the mechanical drive, the projection protruding for example through a housing opening of the housing to actuate the mechanical drive. By means of the projection, the mechanical drive can be actuated from the outside in a very simple manner in order to move the spring-type terminal into the open or closed position.

In one possible embodiment of the connection device according to the invention, the projection is formed on the periphery of the mechanical drive. As a result, the mechanical drive can be rotated in the peripheral direction thereof by actuating the projection, and in this context the spring-type terminal coupled thereto can be actuated by means of the blade thereof.

In a further possible embodiment of the connection device according to the invention, the projection is provided on a first end of an actuation rocker, a depression for introducing a tool, in particular a screwdriver, being provided on the opposite, second end of the actuation rocker. By means of the actuation rocker, a tilting or rocking movement can be provided so as to actuate the mechanical drive. The actuation rocker is provided on the mechanical drive in the peripheral direction so as to rotate the mechanical drive back and forth in the peripheral direction.

In another further possible embodiment of the connection device according to the invention, the mechanical drive comprises at least one knob, by means of which the mechanical drive can be fixed in a predetermined position in the housing (46). For example, the mechanical drive can be held on the housing by means of the knob thereof, for example by frictional contact or gripping contact. In the predetermined position in which the knob of the mechanical drive is held in the housing, the spring-type terminal is for example in the open position thereof.

In yet another possible embodiment of the connection device according to the invention, the mechanical drive comprises a drive element having a first and second end, the blade being provided on the first end. Since the spring-type terminal is actuated by means of the blade, the shape of the drive element may for example be adjusted in such a way that at the second end thereof the actuation element for actuating the mechanical drive and/or the tool seat, such as a slit, can be of a very simple construction, since there is no need to provide a planar and broad face as with the blade.

In a further possible embodiment of the connection device according to the invention, the blade of the mechanical drive is pressed into a slit in the drive element or cast in the drive element, for example by injection-moulding at least in part. In this way, the blade can be fixed to the drive element in a very simple manner.

In another possible embodiment of the connection device according to the invention, the mechanical drive is installed in the housing of the connection device so as to be rotatable in the peripheral direction. A rotational movement of the mechanical drive to actuate the spring-type terminal can be provided in a simple and compact manner in the housing the connection device.

In one possible embodiment of the connection device according to the invention, the housing comprises a cavity-shaped depression in which the housing opening is provided from which the projection protrudes. The cavity-shaped depression makes it possible for the projection to protrude sufficiently from the housing for manual actuation, on the one hand, but at the same time not to have to protrude beyond the width of the housing. Instead, the projection may end together with the housing, meaning that the projection cannot for example be actuated unintentionally from the outside.

In the following, further possible embodiments of the multi-pole switching device according to the invention are explained in greater detail with reference to the appended drawings, in which.

In the following, further possible embodiments of a connection device according to the invention comprising at least one spring-type terminal and the drive thereof are disclosed in detail with reference to the appended drawings. In this context, the connection device is for example a switching device for a busbar system.

Figure 1:
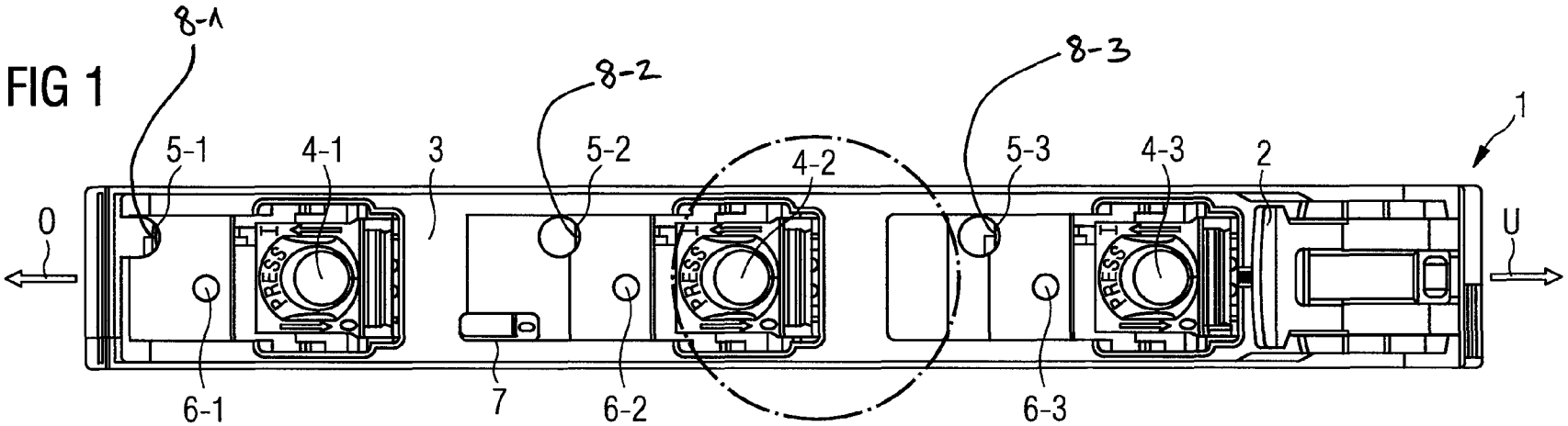
FIG. 1 is a front view of a switching device when switched on, the switching device comprising spring-type terminals and the drives thereof in accordance with a first embodiment.

FIG. 1 is a front view of an example of a switching device 1, for example a multi-pole switching device 1, for a busbar system. In the front view shown in FIG. 1, the multi-pole switching device 1 is switched on, after an operating unit 2, for example a tilt lever, provided on the multi-pole switching device 1 has been pivoted manually into the on state. The multi-pole switching device 1 shown in FIG. 1 can be mounted on a plurality of parallel busbars of a busbar system. For example, the multi-pole switching device 1 can be mounted on three parallel busbars. In the mounted state, the right side of the multi-pole switching device 1 as shown in FIG. 1 is underneath (U) and the left side of the multi-pole switching device 1 as shown in FIG. 1 is above (O). Therefore, in the mounted state, the switching lever 2 shown in FIG. 1 is pivoted upwards to switch on the switching device 1. FIG. 1 shows a front cover 3 of the multi-pole switching device 1 from above or from the front from the user's or assembler's point of view. The front cover 3 is located on the side of the multi-pole switching device 1 remote from the busbars. In the multi-pole switching device 1, the front cover 3 is attached movably to the housing of the switching device 1. The front cover 3 can be displaced laterally or sideways in the multi-pole switching device 1. To achieve the on state shown in FIG. 1 of the multi-pole switching device 1, the front cover 3 travels to the left or upwards (0). When the multi-pole switching device 1 is switched off, for example by actuating the operating unit 2, the front cover 3 travels to the right or downwards (U). In the multi-pole switching device 1, there are a plurality of receiving units 4-1, 4-2, 403, which are each provided for receiving a component, in particular a fuse. The receiving units 4-1, 4-2, 4-3 may for example be drawers, into which a component, in particular an electrical component, can be inserted. The component may for example be a fuse.

In the multi-pole switching device 1, the movable front cover 3 locks the receiving units 4-1, 4-2, 4-3 when the multi-pole switching device 1 is switched on, in such a way that components cannot be inserted or removed. Therefore, in the on state, it is not possible for the assembler accidentally to replace components, in particular electrical fuses, and he is therefore not exposed to the risk of an electric shock. In the embodiment shown in FIG. 1, the multi-pole switching device 1 is a three-pole switching device 1, which can be mounted on three current busbars attached in parallel. The number of receiving units **4-*i* corresponds to the number of current busbars laid parallel. The number of poles or current busbars and the corresponding number of receiving units 4-*i* may vary. For example, the switching device 1** may be formed as a single-pole, two-pole, four-pole switching device etc. instead of as a three-pole switching device.

If the operating unit 2, for example a tilt lever, is actuated by the operator, so as to switch on the multi-pole switching device in accordance with FIG. 1, the front cover 3 moves upwards and locks the receiving units **4-*i*, in particular drawers, for example in each case by means of a journal attached to the front cover 3**.

Figure 5:
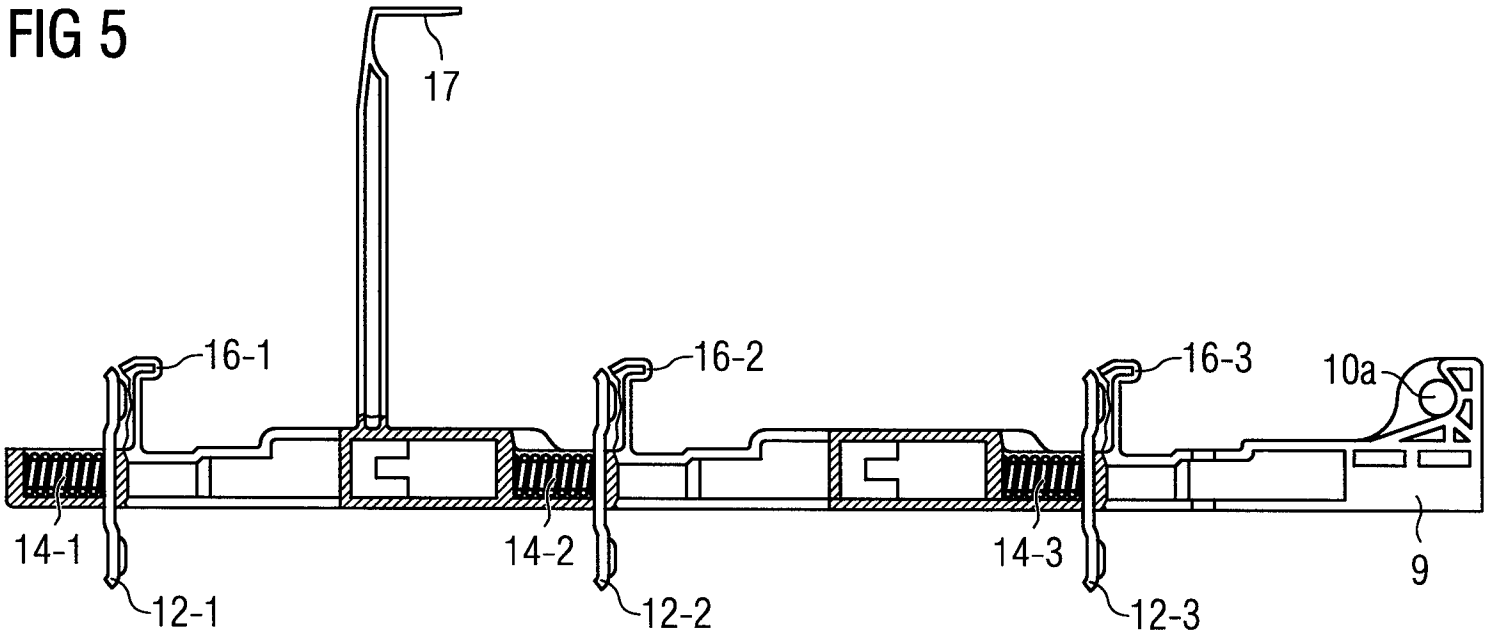
FIG. 5 is a view of a gear linkage used in one possible embodiment of the switching device.

The movable front cover 3 of the multi-pole switching device 1 can be actuated by the operating unit 2, a gear linkage provided inside the housing of the multi-pole switching device being moved in the same direction as or the opposite direction from the front cover 3 in such a way that switch contacts of the multi-pole switching device 1 are closed when the multi-pole switching device 1 is switched on. An embodiment of a gear linkage of this type is shown in FIG. 5.

When the multi-pole switching device 1 is switched on, as shown in FIG. 1, the movable front cover 3 of the multi-pole switching device 1 comprises access openings 5-1, 5-2, 5-3 to the housing of the multi-pole switching device 1, which are provided for mechanical drives 8-1, 8-2, 8-3 of spring-type terminals for gripping connecting lines in place.

As can be seen in FIG. 1, the front cover 3 comprises access openings 5-1, 5-2, 5-3 which are moved to the left in the on state in such a way that the front cover 3 covers access openings in the housing of the multi-pole switching device 1 at these points. In one possible embodiment, these access openings 5-1, 5-2, 5-3 are provided for spring-type terminals for gripping connecting lines in place. By means of the connecting lines, it is possible to connect any desired devices to the busbar system.

As can be seen in FIG. 1, the movable front cover 3 of the multi-pole switching device additionally comprises test holes 6-1, 6-2, 6-3, which each make it possible to contact one output contact with a test pin to check an electrical voltage present there when the multi-pole switching device 1 is switched on. In the three-pole switching device 1 shown in FIG. 1, the front cover has a corresponding number of test holes 6-1, 6-2, 6-3, which make it possible to contact an associated output contact for example by means of a test pin. In this way, in the on state, the assembler or operator can test whether there or not is an electrical voltage U at the output contact of the respective receiving unit **4-*i*. If there is no voltage at the output contact, this may for example be because no electrical component has been inserted into the corresponding receiving unit 4-*i*. There is further the possibility that the electrical component has been inserted into the receiving unit 4-*i* incorrectly. For example, an assembled can insert a standardised single-pole voltage detector into the test holes 6-*i*** so as to test whether a voltage at which the connected electrical device can be operated is present at the respective output contact.

In one possible embodiment of the multi-pole switching device 1, a display area is attached to the gear linkage 9 shown in FIG. 5, and visually displays the actual switching state of the multi-pole device 1 to a user through a viewing window 7 provided in the front cover 3, irrespective of the position of the operating unit 2 and the front cover 3. For example, when the multi-pole switching device is switched on, a correspondingly colour-coded display area is displayed to the user through the viewing window 7 of the front cover 3.

Figure 2:
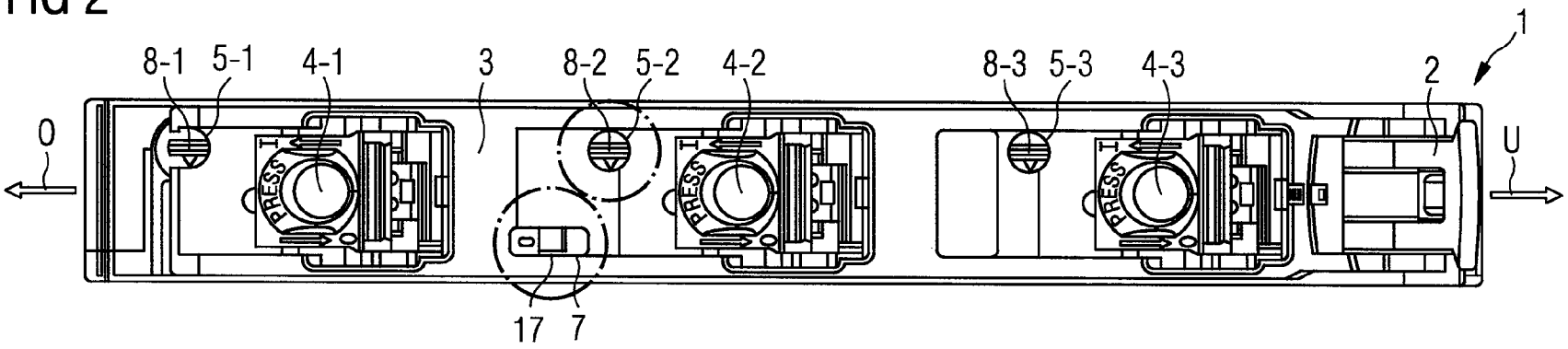
FIG. 2 is a front view of the switching device shown in FIG. 1 when switched off.
Figure 10:
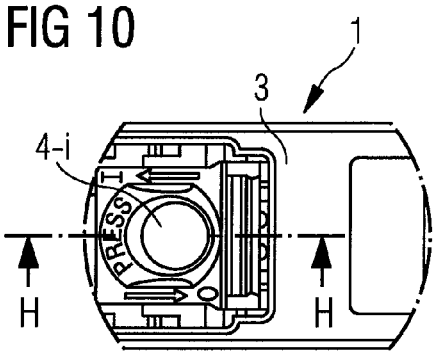
FIG. 10 is a detailed view from above of a locked receiving unit within a front cover in accordance with an embodiment of the switching device.

The movable front cover 3 preferably comprises blocking tabs which block actuation of the receiving units **4-*i* of the multi-pole switching device 1 when the multi-pole switching device 1 is switched on, as is shown in greater detail in FIG. 10, 11, 12. Moreover, when the spring-type terminal is closed, a journal of the movable front cover 3 travels into a corresponding recess of the mechanical drive 8-1, 8-2, 8-3 to switch on the multi-pole switching device 1 when the operating unit 2 is actuated, in such a way that the multi-pole switching device 1 can become switched on, as shown in FIG. 1. Conversely, when the spring-type terminal is open, the journal of the movable front cover 3 does not travel into a corresponding recess of the mechanical drive 8-1, 8-2, 8-3 to switch on the multi-pole switching device 1 when the operating unit 2 is actuated, in such a way that the multi-pole switching device is blocked from being switched on the switching device 1 remains switched off as shown in FIG. 2. The state with an open spring-type terminal is shown in detail in FIG. 13A, 13B, 13C. The state with a closed spring-type terminal is shown in detail in FIG. 14A, 14B, 14C. Therefore, the multi-pole switching device 1 can only be transferred from the off state into the on state by actuating the operating unit 2 if all of the receiving units 4-1, 4-2, 4-3 of the multi-pole switching device 1** have been moved or pivoted to the respective output contact thereof and in addition all of the spring-type terminals for connecting a conductor to the output contact are closed.

FIG. 2 shows the embodiment of a multi-pole 11 shown in FIG. 1 from the front when closed. As can be seen in FIG. 2, the operating unit or the tilt lever 2 is pivoted to the right or downwards (U) and the multi-pole switching device 1 is switched off. When the switching device 1 is switched off, the movable front cover 3 moves to the right with respect to the housing of the multi-pole switching device 1. As can be seen from FIG. 2, when the multi-pole switching device 1 is switched off access openings inside the housing of the switching device 1 are exposed. For this purpose, the openings 5-1, 5-2, 5-3 travel within the front cover 3 so as to fit exactly over the access openings inside the housing of the switching device 1, as shown in FIG. 2. In the embodiment shown in FIG. 2, the access openings 5-1, 5-2, 5-3 for mechanical drives **8-*i* of spring-type terminals are provided for gripping connecting lines in place. In FIG. 2, the mechanical drives 8-1, 8-2, 8-3 of spring-type terminals can be seen from above. When the multi-pole switching device 1 is switched off, the test holes are covered at least in part in the embodiment shown, since it is not necessary to test the electrical voltage present at the output contacts. As is shown in FIG. 2, the display area 17 visible in the viewing window 7 of the front cover 3** shows the user that the multi-pole switching device is switched off.

If the operating unit 2, for example a tilt lever, to which the gear linkage 9 comprising the switch contacts is coupled, is actuated into the OFF position, the front cover 3, which is likewise fixed to the tilt lever 2, moves downwards or back. This simultaneously causes the necessary space to be freed for tilting and pulling out the receiving units 4-1 4-2, 4-3, for example drawers for electrical fuses. This ensures that it is only possible to actuate the receiving units **4-*i*, for example fuse holders or fuse drawers, and to exchange the component in a risk-free zero-voltage state. Likewise, the mechanical drives 8-1, 8-2, 8-3 of the spring-type terminals for the output lines are only accessible to the user when the multi-pole switching device 1 is switched off. In the OFF position, the openings 5-1, 5-2, 5-3 in the front cover 3 are located directly above the openings in the housing of the multi-pole switching device 1. As a result, the mechanical drives 8-1, 8-2, 8-3 of spring-type terminals can subsequently be operated by the assembler through the superposed openings. When the front cover is in the on state, as shown in FIG. 1, the front cover 3 is displaced such a distance that the openings 5 in the front cover 3 and the access openings inside the housing of the switching device 1 are no longer superposed, and thus prevent access to the mechanical drives 8-1, 8-2, and 4-1 8-3 of the spring-type terminals. When the switching device 1 is switched off, as shown in FIG. 2, the receiving units 4-1, 4-2, 4-3 of the switching device 1 are unlocked and can for example be pulled out of the housing of the multi-pole switching device 1 via a guide groove, so as in each case to insert a component into the pulled-out receiving unit. When switched off as shown in FIG. 2, the multi-pole switching device 1 can only be transferred into the on state in accordance with FIG. 1 if all of the receiving units 4-1, 4-2, 4-3 of the multi-pole switching device have been retracted again and moved or pivoted to the respective output contacts thereof, and moreover all of the spring-type terminals for connecting conductors to the output contacts are closed. In one possible embodiment, the receiving units 4-1, 4-2, 4-3 for receiving an electrical component, for example a fuse, are formed by drawers, into each of which a component can be inserted when the multi-pole switching device 1 is switched off. The receiving unit 4-*i*, in particular a drawer, can preferably be pivoted about an axis and pulled out from the hosing of the multi-pole switching device 1 when the multi-pole switching device 1 is switched of so as to insert the component. The drawer thus cannot fall out or be lost. After the component has been inserted, the drawer can be slid back into the housing when the multi-pole switching device 1 is switched off, and subsequently pivoted about the axis in such a way that the drawer is positioned against the respective output contact and an electric circuit is thus closed. When the multi-pole switching device 1 is switched off, in other words when the front cover has moved downwards, there is sufficient space or room to pivot and pull out the drawers. When the multi-pole switching device 1 is switched off, the drawers can also be slid back into the housing and subsequently pivoted against the respective output contact. Once all of the receiving units 4-1, 4-2, 4-3 have been slid into the housing of the multi-pole switching device 1 and pivoted against the respective output contacts, the multi-pole switching device 1 can be brought or switched into the on state shown in FIG. 1 manually if additionally all of the spring-type terminals for connecting conductors to the associated output contacts are closed. As a result, errors in mounting the devices on the multi-pole switching device are detected and prevented. For example, if an assembler mistakenly forgets to close a spring-type terminal, the multi-pole switching device 1 cannot be switched on. In this case, it is possible for the assembler subsequently to close the spring-type terminal, in such a way that it is subsequently possible to switch on the multi-pole switching device. This embodiment has the advantage that incorrect assembly of devices on the multi-pole switching device can be highlighted and eliminated. In one possible embodiment of the multi-pole switching device 1**, the housing comprises two housing shells.

Figure 3:
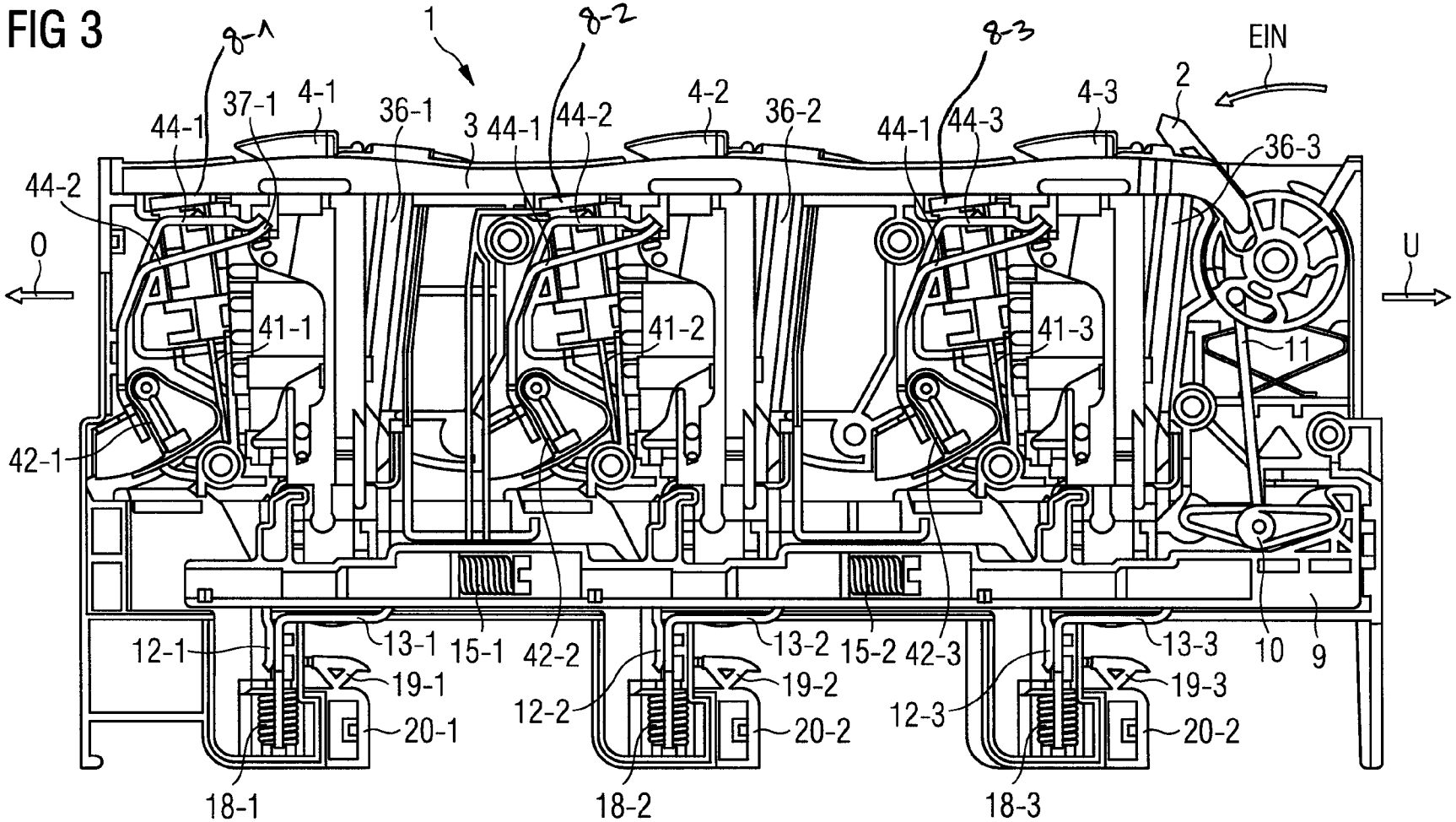
FIG. 3 shows an embodiment of the switching device when switched on, the switching device comprising spring-type terminals and the drives thereof in accordance with the first embodiment.

FIG. 3 is a view into the multi-pole switching device without an upper housing part when the multi-pole switching device 1 is switched on. As can be seen in FIG. 3, the tilt lever 2 is pivoted anticlockwise to the left, the front cover 3 likewise moving left or upwards and thus locking the receiving units **4-*i*. In an alternative embodiment, the front cover 3 moves in the opposite direction from the tilt lever 2. At the same time, the gear linkage 9 provided inside the housing of the multi-pole switching device 1, as shown in FIG. 5, is moved in the same direction as the front cover 3 right or downwards (U) via a knee lever 10 via a rod or an elongate bracket 11 which is connected to the tilt lever 2, switch contacts of the multi-pole switching device 1 being closed in the end position when the multi-pole switching device 1 is switched on. In FIG. 5, a bearing 10*a* for the knee lever 10 can be seen. When the tilt lever 2 moves anticlockwise into the setting, the knee lever 10 presses the gear linkage 9 downwards or right in a U-shaped portion of said linkage. The gear linkage 9 thus moves in the opposite direction from the front cover 3. AAs can be seen in FIG. 5, there are switch contacts 12-1, 12-2, 12-3 on the gear linkage 9 so as to close an associated circuit when the multi-pole switching device 1 is switched on, if the associated component has been inserted into a corresponding receiving unit 4-*i* and pivoted against the associated output contact. In the embodiment shown in FIG. 5, the switch contacts 12-1, 12-2, 12-3 are switching bridges. These switching bridges connect a base contact of the respective pivotable drawer together with a busbar contact 13-1, 13-2, 13-3 of the multi-pole switching device 1 when the multi-pole switching device 1 is switched on. To achieve the necessary contact force, an associated compression spring 14-1, 14-2, 14-3 is provided for each switching contact or each switching bridge 12-1, 12-2, 12-3, as is shown in FIG. 5. Each switching bridge 12-*i* comprises two switching contacts, which are provided on the two distal ends. In the on state, these contacts produce on the one hand contact with a base contact of the pivotable drawer or receiving unit 4-*i* and on the other hand contact with a busbar contact 13-*i* which contacts the associated busbar rail. The restoring springs 15-1, 15-2 ensure a stable, self-reinforcing position of the gear linkage when the multi-pole switching device 1 is switched on. In the embodiment shown in FIG. 5, the gear linkage 9 additionally comprises contours 16-1, 16-2, 16-3, which are provided for locking the drawers in the case of welded contacts. Further, the display area 17 is attached to or integrally formed on the gear linkage, and visually displays the actual switching state of the multi-pole switching device 1 to a user through the viewing window 7 provided in the front cover 3, irrespective of the position of the operating unit 2** and the front cover.

On each rail contact 13-*i* of the multi-pole switching device, there is preferably a compression spring 18-1, 18-2, 18-3, which is used to compensate play and to provide a contact force and ensures rigid mounting of the multi-pole switching device 1 on the busbars.

For each rail, the switching device 1 comprises an associated rail contact 13-*i* for electrically contacting the respective rail. In the embodiment shown in FIG. 3, a housing contour 19-*i*, integrally formed on the housing of the switching device 1 and opposing the respective rail contact, is located on each rail contact 13-*i* of the switching device, and can be removed mechanically for placing the switching device 1 on a thick rail. The housing contour 19-1, 19-2, 19-3 may be removed by means of a tool. In this context, the integrally formed housing contour 19-*i* is for example broken out from the hosing of the switching device 1 using a screwdriver. For a thin rail, having a thickness of for example 5 mm, the housing contour 19-1 remains intact. For a thicker rail, having a thickness of for example 10 mm, the housing contour 19-*i* is removed by an assembler using a screwdriver. The housing contour 19-*i* forms a combination foot, which can for example be broken off below the support face of a thick busbar of for example 10 mm thickness. This ensures clean placement on the busbar. A special shape of the housing contour 19-*i* ensures that when the housing contour is broken out the busbars do not come to be positioned on the brake, but on separate faces. The integrally formed housing contour 19-*i* is provided on a support tab 20-*i*, opposite the respective rail contact 13-*i*, of the housing for placing the switching device on the rail. In the embodiment shown in FIG. 3, the integrally formed housing contour is hump-shaped and comprises two webs which converge together and which are integrally formed on the support tab 20-*i*, opposite the rail contact 13-1, of the housing. In one possible embodiment of the switching device 1, the housing of the switching device 1 consists of plastics material. In this case, the integrally formed housing contour 19-*i* also consists of plastics material.

Figure 4:
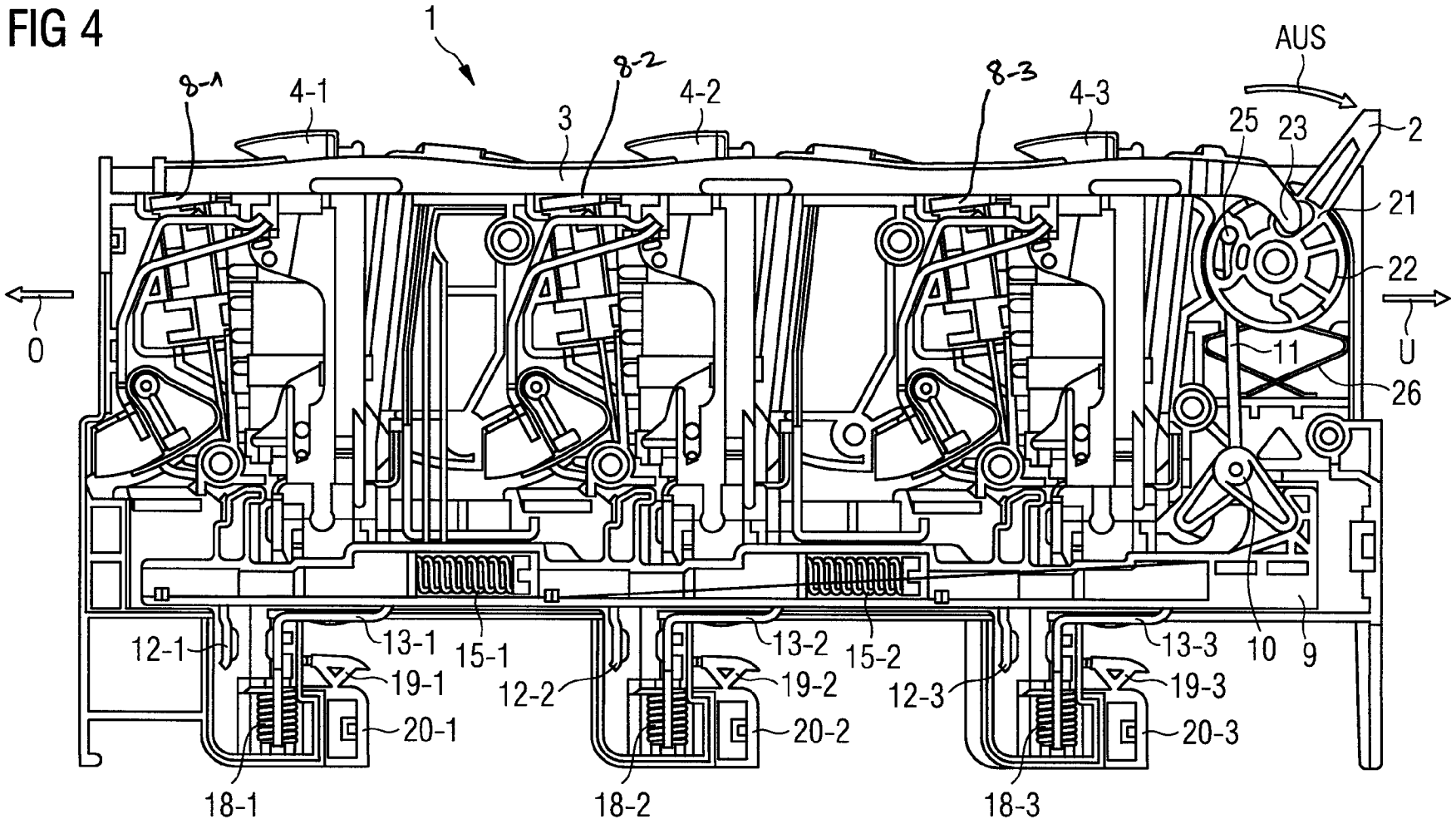
FIG. 4 is a view without a housing lid of the switching device shown in FIG. 3 when switched off.
Figure 16:
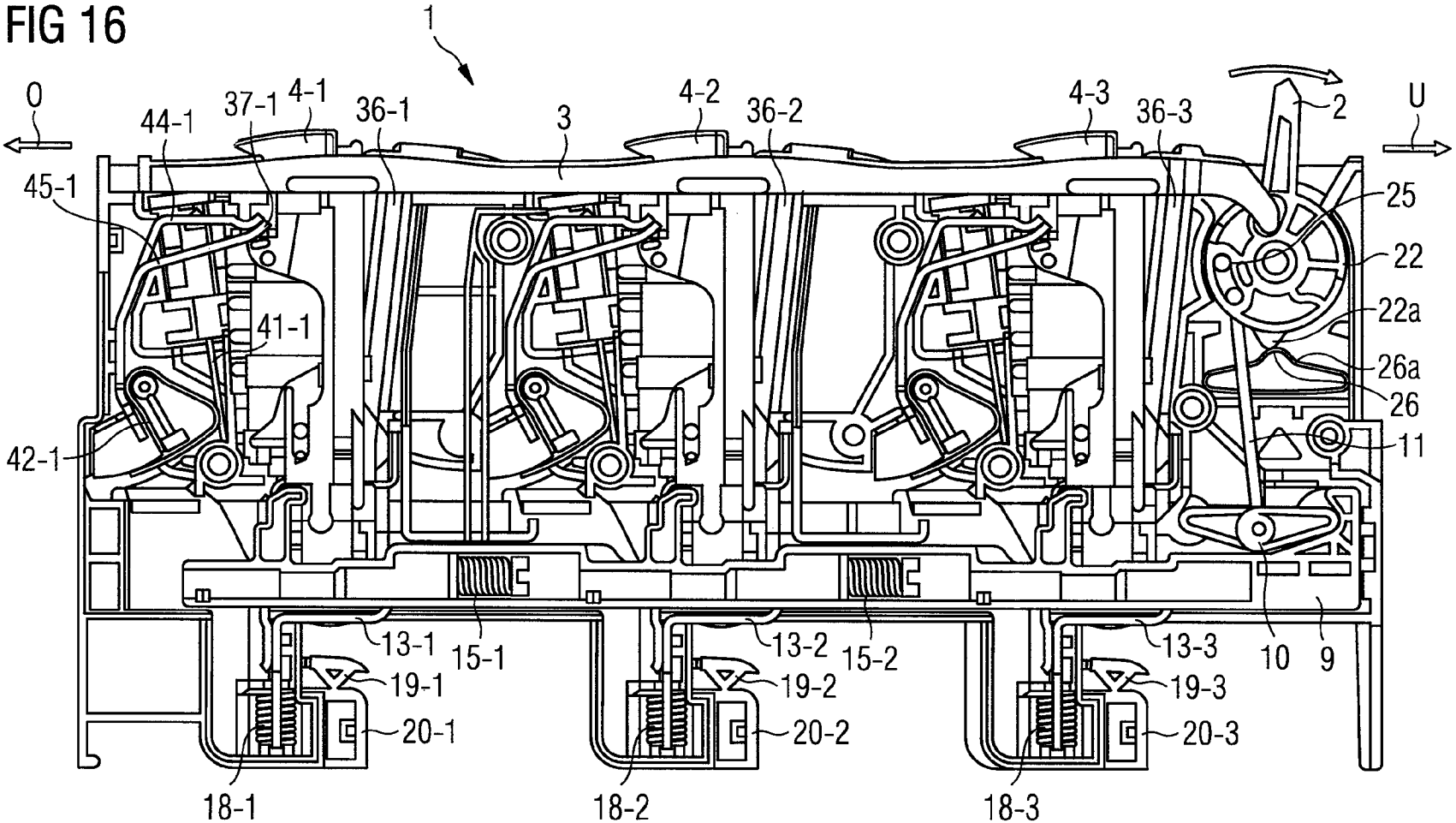
FIG. 16 shows an embodiment of a switching device to illustrate the mode of operation of an actuable operating unit used in the switching device.

By operating the tilt lever 2 downwards or rightwards, the multi-pole switching device 1 is switched off, as shown in FIG. 4. When the switching device 1 is switched off, the tilt lever 2 is rotated clockwise, downwards or right, in such a way that the front cover 3 is likewise pulled to the right. In the embodiment shown in FIG. 4, the front cover 3 engages on the lower distal end in a recess 21 of a wheel 22 which is connected to the tilt lever 2. The distal lower end 23 of the front cover 3 is thus pulled downwards in such a way that the receiving units 4-*i* are unlocked when the multi-pole switching device 1 is completely switched off. By moving the tilt lever 2 clockwise, the bracket 11, in particular a wire bracket, which is connected to the knee lever 10, is moved upwards. At the upper end thereof, the bracket 11 is guided into a further recess or slot 25 of the tilt lever wheel 22 with degrees of freedom, and is moved upwards clockwise by the pivoting of the tilt lever 2. The recess 25 is a slot which gives the wire bracket 11 one degree of freedom of movement. The upwardly moving bracket 11 simultaneously pulls in the knee lever 10, in such a way that the gear linkage 9 is moved left or upwards by spring force, in other words in the opposite direction from the front cover 3. The knee lever 10 is positioned on a U-shaped portion of the gear linkage 9, as is shown in FIG. 3, 4. As can be seen from FIG. 3, 4, a specially shaped planar spring or leaf spring 26 is located below the wheel 12 and preferably comprises a bulge 26*a* as shown in FIG. 16. The knee level 10 ensures switching hysteresis during switching. The resistance force which occurs can be set using the leaf spring 26. Further, the leaf spring 26 ensures a reduction in the mechanical play of the tilt lever, resulting in a more pleasant operating feel for the user. The kinematics or switching speed can be set using the form of the leaf spring 26. By means of the specially shaped leaf spring 26, it is possible to define a particular switching point, the switching lever 2 transitioning into the other switching state without further exertion of force once the switching point has been passed. For example, if the operator pulls the switching lever 2 downwards, or clockwise as shown in FIG. 3, 4, the operator has to apply force until the switching point is reached, and once the switching point has been passed the switching lever 2 moves into the final switch position, in other words into the off state, without the person exerting further force. In the same way, for switching on the multi-pole switching device 1, the operator can move the switching lever 2 upwards anticlockwise, and in doing so has to apply force until the switching point is reached. Once the switching point has been passed, the switching lever 2 subsequently automatically moves into the final switching position shown in FIG. 3. Therefore, once the switching point has been passed, in particular in a process of switching off, the switching device 1 switches off independently of the operator by means of the slot 25, the leaf spring 26, the restoring springs 15 and the knee lever 10.

Figure 6:
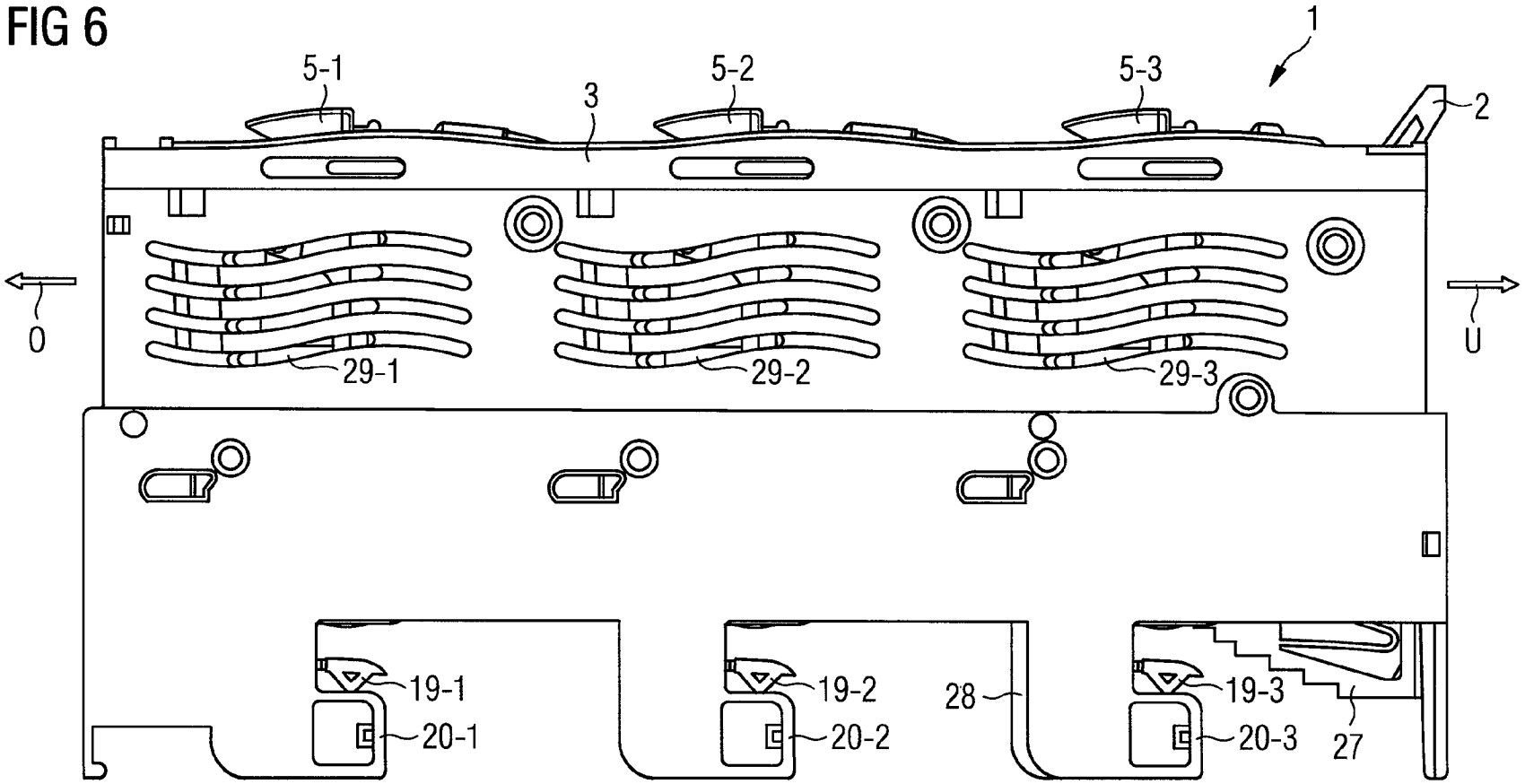
FIG. 6 is a side view of an embodiment of the switching device from the left.

FIG. 6 is a side view of the housing of the multi-pole switching device 1 when switched off. The three-pole switching device 1 shown in FIG. 6 comprises three support tabs 20-1, 20-2, 20-3 on the underside thereof, which are provided for placing the switching device 1 on three busbars. In the embodiment shown in FIG. 6, an associated housing contour 19-*i* is integrally formed on each support tab 20-*i*, and can be removed for placing the switching device 1 on the thick rails. Further, a latch element 27 is provided for the lowest busbar in the embodiment shown in FIG. 6. Further, in the embodiment shown in FIG. 6, a spacing rib 28 is provided for the central busbar, and protects the cover screens when the device is latched on. As can be seen in FIG. 6, there may be wavy cooling slits 29-1, 29-2, 29-3 in the housing of the multi-pole switching device 1.

Figure 7:
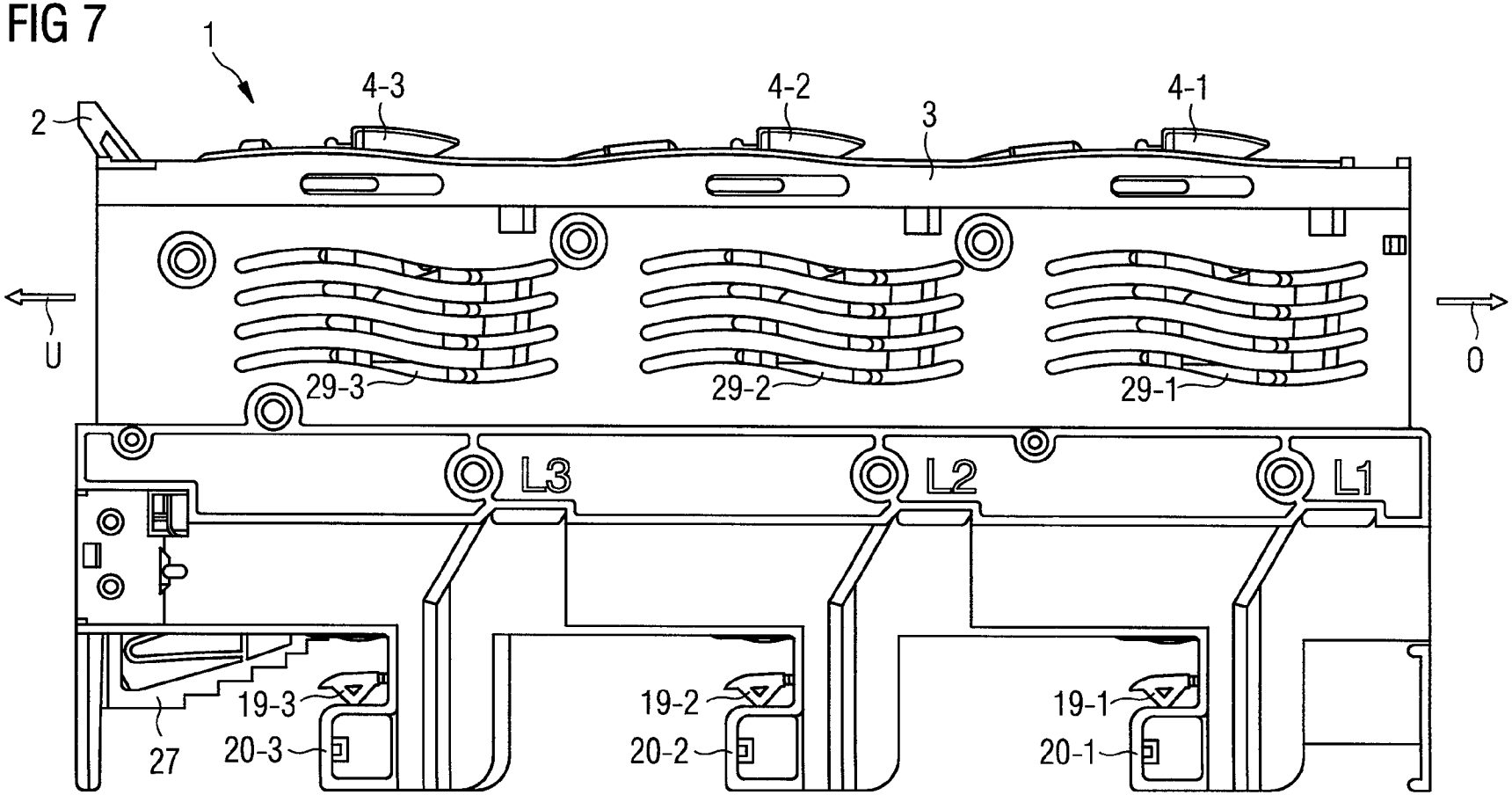
FIG. 7 is a side view of an embodiment of the switching device from the right.

FIG. 7 is a side view from the right of the housing of the multi-pole switching device 1 when switched off. The three-pole switching device 1 shown in FIG. 6, 7 can be placed on three busbars having three phases L1, L2, L3.

Figure 8:
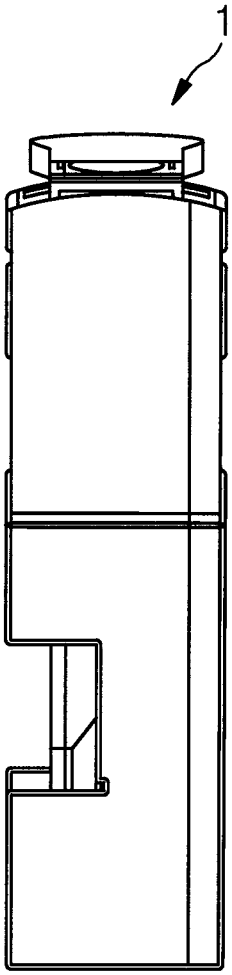
FIG. 8 is a view of an embodiment of the switching device from above.
Figure 9:
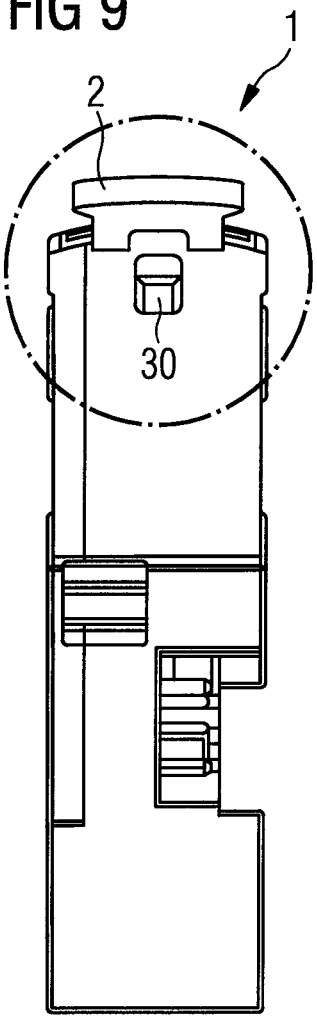
FIG. 9 is a view of an embodiment of the switching device from below.
Figure 18A:
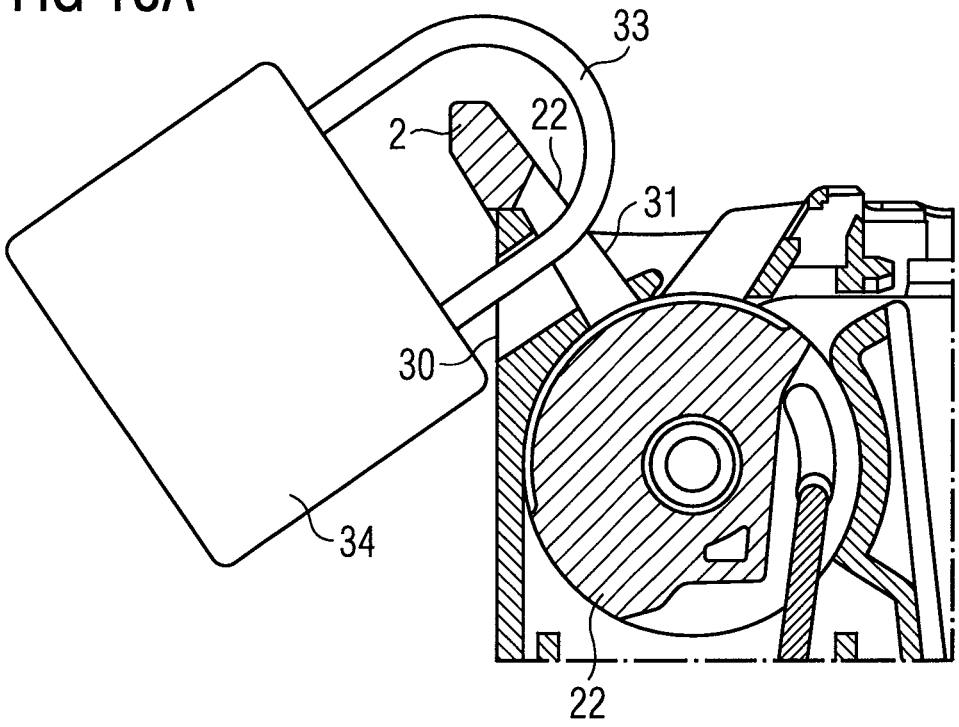
FIG. 18A, 18B are detailed views to illustrate a sealing device provided in the front cover of the switching device.
Figure 18B:
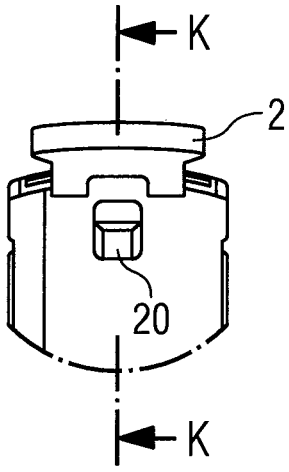

FIG. 8 is a view of the housing of a multi-pole switching device 1 from above. FIG. 9 is a view of the housing of the multi-pole switching device 1 from below. As can be seen in FIG. 9, an opening 30 is provided in the housing of the multi-pole switching device 1 and can be used for suspending a U-lock. This is shown in detail in FIG. 18A, 18B. As can be seen in FIG. 18A, in one possible embodiment the tilt lever 2 may be connected to the wheel 22 of the tilt lever 2 via a web 31, an opening 32 through which a U-shaped bar 33 of a U-lock can be passed being provided in the web 31. The bar 33 can thus be passed both through the opening 30 in the housing of the multi-pole switching device 1 and through the opening 32 in the connecting web, so as to prevent the tilt lever 2 from pivoting from the off position into the on position in the embodiment shown. As an alternative to the U-lock shown in FIG. 18A, sealing may also take place in the on state by way of the two openings. The opening 30 inside the housing forms a sealing opening for sealing the multi-pole switching device 1.

In one embodiment, it is also possible for the multi-pole switching device, when switched on, to be blocked using a sealing device or a padlock. Which of the two alternatives is selected depends on the respective application. FIG. 18A is a sectional view along the section line K-K in FIG. 18B, with the switching lever in the off state. The sealing opening 30 inside the housing of the multi-pole switching device 1 provides an additional safety measure against incorrect operation, in particular by inexperienced users or unauthorised third parties.

Figure 11:
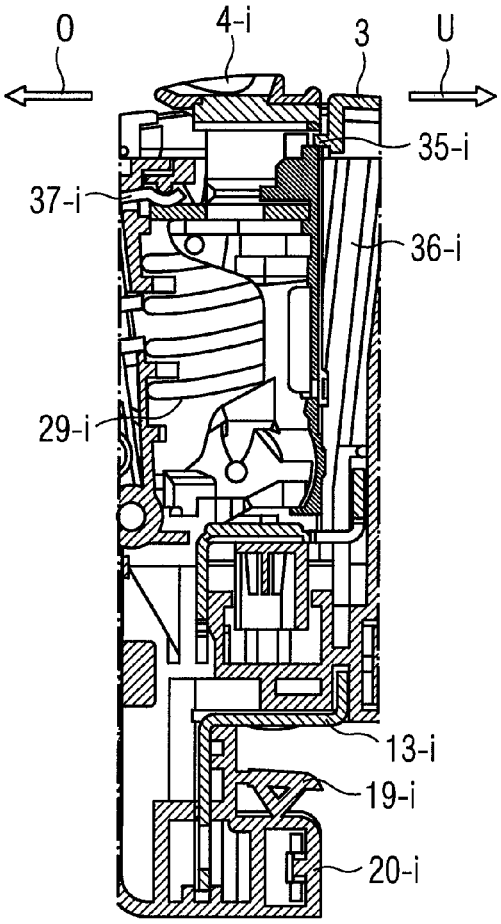
FIG. 11 is a sectional view along the section line H-H of the receiving unit shown in FIG. 10 when locked.

FIG. 10 is a detailed view of a multi-pole switching device 1 from above in a region of the front cover 3 in which a receiving unit 4-*i* for receiving a component is located. In the embodiment shown in FIG. 10, the receiving unit 4-*i* is a drawer which is locked. FIG. 11 is a sectional view along the section line H-H in FIG. 10. When the multi-pole switching device 1 is switched on, the front cover 3 is moved upwards and locks the receiving unit 4-*i* by means of a corresponding blocking tab 35-*i*, as is shown in FIG. 11. In the on state, the blocking tab 35-*i* engages in the drawer 4-*i*, in such a way that it cannot be actuated by a user.

Figure 12:
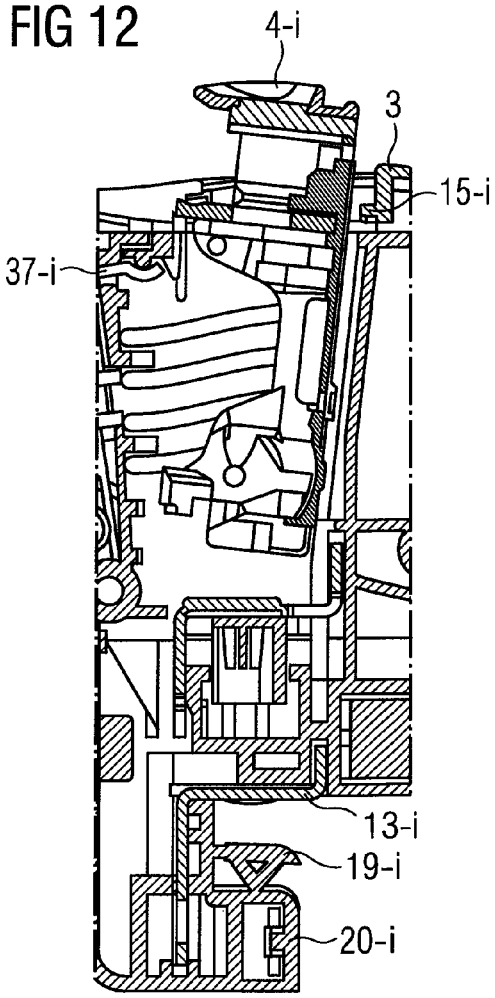
FIG. 12 is a sectional view of a receiving unit along the section line H-H in the embodiment shown in FIG. 10 of a switching device.

FIG. 12 is a sectional view along the section line H-H when the multi-pole switching device 1 is switched, in which the front cover 3 has been moved laterally to the right or downwards, in such a way that the blocking tab 35-*i* no longer blocks the receiving unit 4-*i* or drawer 4-*i*. In the off state, when the drawer 4-*i* is unlocked, the multi-pole switching device 1 can no longer be switched on. In this case, the receiving unit or drawer blocks the front cover 3. When the multi-pole switching device 1 is switched off, as shown in FIG. 12, the receiving unit or drawer 4-*i* is unlocked and can be pulled out of the hosing of the multi-pole switching device 1, via a guide groove 36-*i* which can be seen in FIG. 11, so as to insert a component into the pulled-out receiving unit. As can be seen in FIG. 11, the guide groove 36-*i* comprises two opposite guide webs which are used for pulling out and retracting the drawer. In FIG. 11, the receiving unit or drawer 4-*i* is shown without an inserted component, and the ventilation slits 29-*i* of the hosing can be seen in the background. If a component 4-*i*, for example a fuse, has been inserted into the drawer 4-*i*, it connects an output contact 37-*i*, shown in FIG. 11, to a base contact. The base contact is opposite a switching bridge 12-*i* associated with one of the switch contacts. There may additionally be a compression spring below the base contact, so as to ensure good contact. In the on state, when the drawer 4-*i* is locked, the switch contact or switching bridge 12-*i* attached to the gear linkage 9 connects the base contact of the receiving unit 4-*i* to the current busbar contact 13-*i*. The circuit is closed if the inserted component is positioned between the output contact 37-*i* and the base contact of the drawer after the drawer 4-*i* is pivoted. The output contact 37-*i* is guided to a connection contact for contacting an electrical device via an internal line. This connection contact has a spring-type terminal 42-*i*.

Figure 13A:
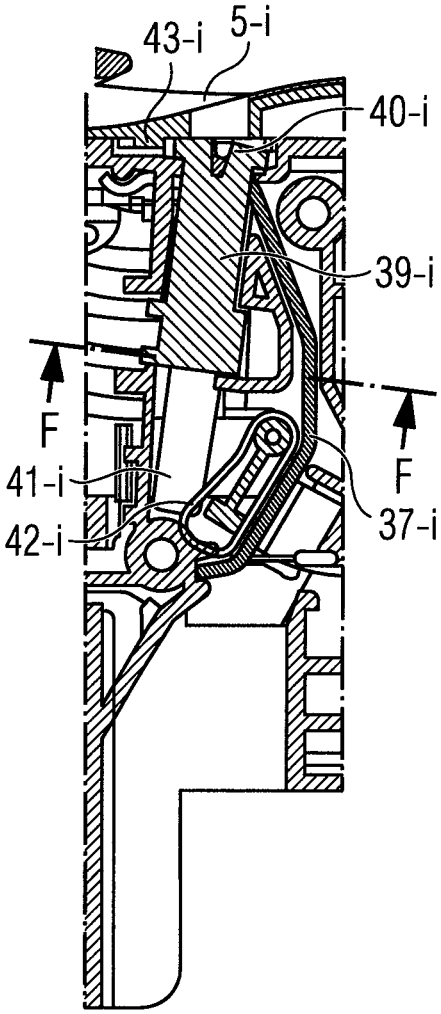
FIG. 13A, 13B, 13C are views depicting an open spring-type terminal in accordance with the first embodiment to illustrate the mode of operation of an embodiment of the switching device.
Figure 13C:
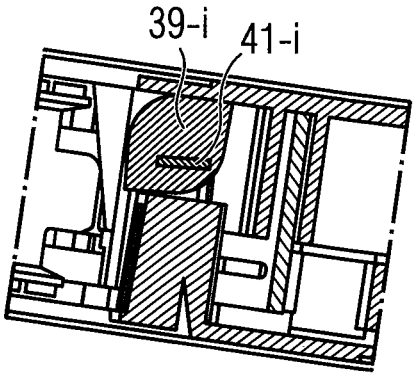
Figure 13B:
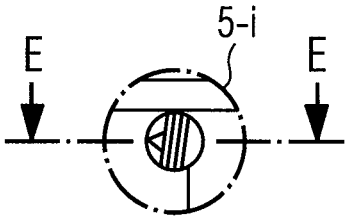

FIG. 13A is a sectional view along the section line E-E of the drive, shown from the front in FIG. 13B, of the spring-type terminal. In FIG. 13A, 13B, 13C, the respective spring-type terminal 42-*i* is open. In the front cover 3, there is an opening 5-*i*, which is positioned directly above an access opening inside the housing of the multi-pole switching device, as shown in FIG. 13B, when the multi-pole switching device is switched off. When the multi-pole switching device 1 is switched on, these access openings are covered and cannot be operated. When the multi-pole switching device 1 is switched off, the access openings are not covered and are accessible, as is shown in FIGS. 13B and 14B. When the multi-pole switching device 1 is switched off, the spring-type terminals 42-*i* can be rotated using a tool. In one possible embodiment, the configuration of the drives 8-1 for the spring-type terminals makes a rotation of approximately 95° possible. With additional knobs, it can be ensured that the open spring-type terminal 42-*i* remains in a stable position. This prevents unintentional opening. Integrating the drive element 39-*i* in a press fit can prevent vibration and flapping during operation.

FIG. 13A shows the drive of the spring-type terminal in the blocking direction. The front cover 3 cannot enter the clearance in the drive 39-*i* of the spring-type terminal 42-*i*, and so it is not possible to switch on the multi-pole switching device 1. FIG. 13C is a sectional view along the section line F-F of FIG. 13A, the drive of the spring-type terminal being open.

Figure 14A:
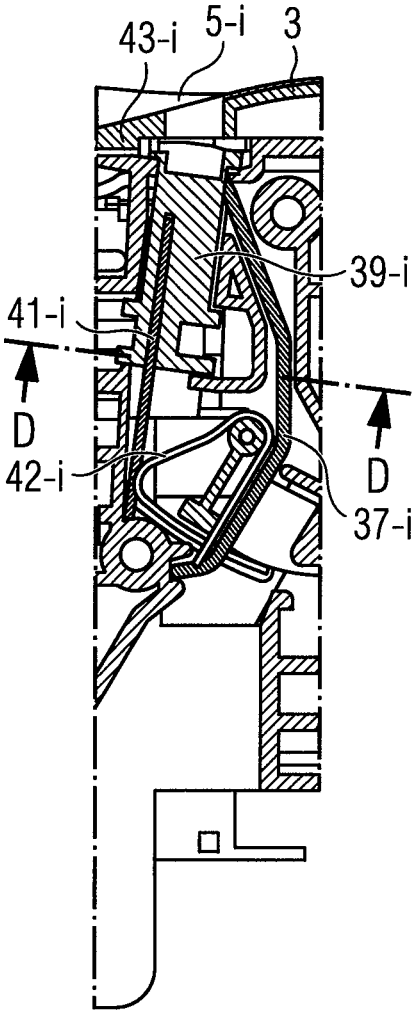
FIG. 14A, 14B, 14C are views of a closed spring-type terminal in accordance with the first embodiment to illustrate the mode of operation of a possible embodiment of the switching device.
Figure 14C:
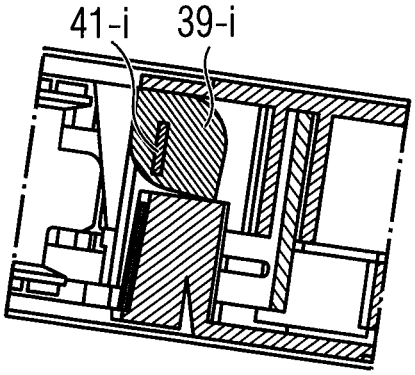
Figure 14B:
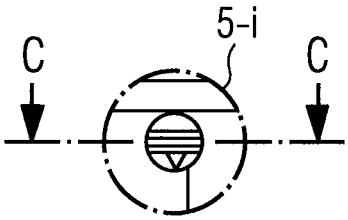

By contrast, FIG. 14A, 14B, 14C show the state in which the spring-type terminal 42-*i* is closed. The multi-pole switching device is switched off, as shown for example in FIG. 2, and so the openings 5-*i* inside the front cover 3 are positioned exactly covering access openings inside the housing of the multi-pole switching device 1. The spring-type terminal 42-*i* for the respective output contact 37-*i* comprises a mechanical drive 8-*i* having a drive element 39-*i*, which for example comprises a slit 40-*i* for applying a screwdriver, as shown in FIG. 13A. A metal blade 41-*i* is inserted into the mechanical drive element 39-*i* of the drive 8-*i*, and is rotated during the rotation of the screwdriver. The metal blade 41-*i* of the drive element 39-*i* is positioned on a spring-type terminal 42-*i*, as shown in FIG. 14A. FIG. 14A shows the spring-type terminal closed. As can be seen in FIG. 14A, when the spring-type terminal 42-*i* is closed, a journal 43-*i* of the front cover 3 can enter the mechanical drive 8-*i*, into the drive element 39-*i* of the mechanical drive 8-*i*, to switch on the multi-pole switching device 1. When the spring-type terminal 42-*i* is closed, the journal of the movable front cover 3 enters a corresponding recess in the mechanical drive 8-*i* of the spring-type terminal 42-*i* when the operating unit 2 is actuated to switch on the multi-pole switching device 1, and so that the multi-pole switching device 1 can become switched on. Conversely, when the spring-type terminal 42-*i* is open, as shown in FIG. 13A, the journal 43-*i* of the movable front cover cannot enter the corresponding recess of the mechanical drive 8-*i* of the spring-type terminal when the operating unit 2 is actuated to switch on the multi-pole switching device 1, and so the multi-pole switching device 1 is blocked from switching on and the switching device 1 remains switched off. If an assembler accidentally forgets to close a spring-type terminal of a connected device, the multi-pole switching device 1 is blocked from switching on. Only when the assembler has closed the corresponding spring-type terminal 42-*i*, and the mounting of the device is thus properly completed, can the multi-pole switching device 1 be switched on.

Figure 15:
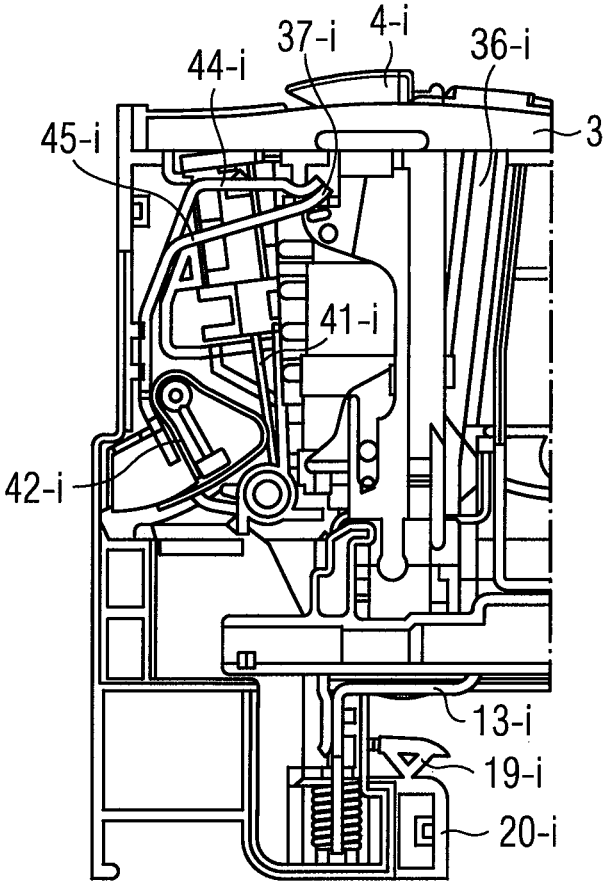
FIG. 15 is a drawing of an example implementation of an output contact using in the switching device.

FIG. 15 is a sectional view through a multi-pole switching device 1, illustrating more precisely an embodiment of an output contact 37-*i* which can be used in the multi-pole switching device 1 for any receiving unit. In the example implementation shown in FIG. 15, the output contact 37-*i* is connected via two current brackets 44-*i*, 45-*i* to the spring-type terminal 42-*i*, into which an output line or contact line for an electrical device can be inserted. Similarly to FIG. 14A, FIG. 15 shows a closed spring-type terminal 42-*i*. the lower resilient part of the output contact 37-*i*, in other words the lower bridge 45-*i*, ensures that the current supply is not interrupted if the receiving unit or drawer 4-*i* is pressed when the multi-pole switching device 1 is switched on.

FIG. 16 is a view of an embodiment of the multi-pole switching device 1 without an upper housing part and without a latching element, the tilt lever in the on state being moved into the off state, and having overcome a force maximum as a result of the special form of the leaf spring 26. The leaf spring 26 comprises a hump-shaped bulge or lobe 22*a* of the wheel 22. As can be seen in FIG. 16, at this time the knee lever 10 and the gear linkage 9 are still located in the "ON" position and the wire bracket 11 runs freely in the recess of the wheel 22 of the tilt lever 2.

Figure 17:
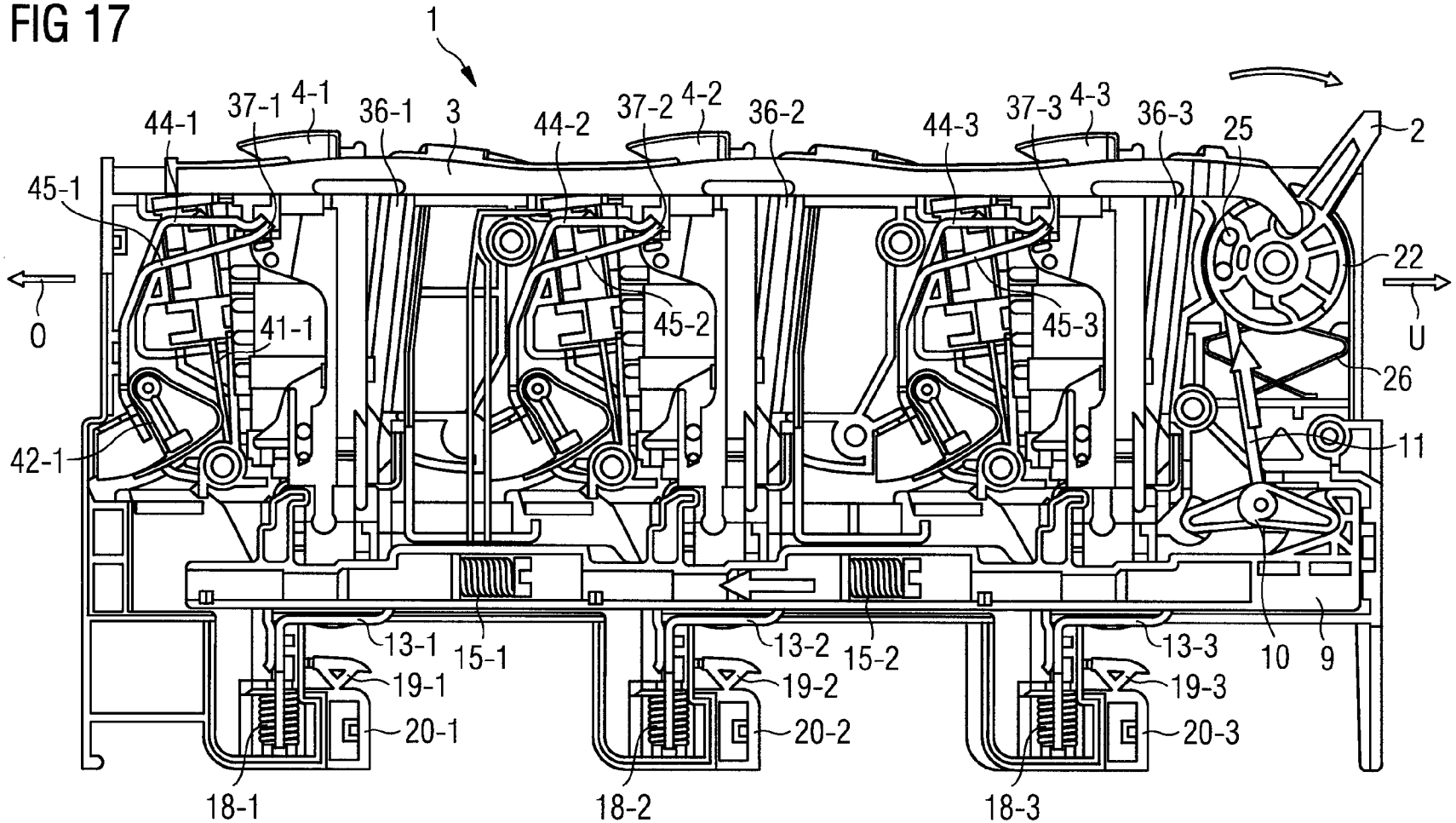
FIG. 17 shows an embodiment of the switching device to illustrate the mode of operation of an actuable operating unit used by the switching device.

FIG. 17 is a view of an embodiment of the multi-pole switching device 1 without an upper housing part and without a latching element, when the switching lever 2 moves further downwards clockwise. If the tilt lever 2 is already in the off position, the gear linkage 9 moves left or upwards under the force of the restoring springs 15-1, 15-2, the wire bracket 11 being slid upwards and making use of the free run or the slot 25 inside the wheel 22 of the tilt lever 2 for movement. In the embodiment shown in FIG. 17, two restoring springs 15-1, 15-2 are provided. In an alternative embodiment, it is also possible to provide only one restoring spring 15. the restoring springs 15-*i* ensure that the switching slide or gear linkage 9 is moved upwards in the opposite direction from the front cover 3 to interrupt the current path extending via the switching bridges 12-*i* when the multi-pole switching device 1 is switched off. The formation of the two knee lever halves of the knee lever 10, together with the restoring springs 15-*i*, ensures that the mechanical system is blocked in this position in a self-reinforcing manner when the multi-pole switching device 1 is switched on. The mounting of the knee lever halves and the external diameters thereof ensure optimised force transmission. The specially shaped leaf spring 26 having the bulge 26*a* leads to a defined force path during switching on and off. In each switching process, a small switching force is initially required, and increases until a switching force maximum is reached, the switching force subsequently decreasing again once the switching force maximum is exceeded. Further, the leaf spring 26 holds the tilt lever 2 in a stable position in the end positions, in other words when the multi-pole switching device 1 is switched on and off. A free run in the form of a slot 25 ensures that when the multi-pole switching device 1 is switched of the bridge contacts are not opened until the tilt lever 2 has overcome the point of greatest switching force defined by the leaf spring 26. Once the dead point of the knee lever articulations has been passed, because of the slot 25 it is possible for the switching-off process no longer to be maintained by the user. The restoring springs 15-*i* on the gear linkage 9 ensure that the gear linkage 9 automatically reaches the "OFF" position (switching off independently of the user). During switching-on, a planar spring can ensure that the operator has to overcome a high force and immediately afterwards the switching force is reduced (switching on virtually independently of the user). A flag indicator or display area 17, which is integrally formed on or integrated into the gear linkage 9, provides the user with an independent switching position display.

The switching device 1, for example a multi-pole switching device 1, is suitable for inserting components, in particular electrical fuses. Alternatively, other electrical components may also be inserted into the various receiving units 4-*i* of the multi-pole switching device 1, so as to be connected in the respective electric circuit. Examples of components of this type are coils and capacitors. The switching device 1 provides a high level of safety for the user or assembler during mounting and when inserting components into the switching device 1. When the switching device 1 is switched on, the receiving units 4-*i* are locked as a result of the blocking tabs integrated into the front cover 3, and so it is not possible for the user even to reach the current-carrying parts. Further, the journals provided in the movable front cover 3 ensure that the switching device 1 can only become switched on when the spring-type terminals 42-*i* are properly closed. Only when all of the receiving units 4-*i* of the multi-pole switching unit 1 have been pivoted to the respective output contact thereof, and in addition all of the spring-type terminals 42-*i* for connecting a conductor to the respective output contact have been closed, can the multi-pole switching device 1 be transferred from the off state into the on state by actuating the operating lever 2. Therefore, if the assembler inserts a contact line into a spring-type terminal 42-*i* of the multi-pole switching device 1, but forgets to close the spring-type terminal by actuating the mechanical drive 8-*i*, the multi-pole switching device 1 cannot be brought into the on state. This prevents a contact line which has merely been inserted into the spring-type terminal 42-*i* from subsequently being able to be released from the spring-type terminal 42-*i* again after it is forgotten to close the spring-type terminal 42-*i* after mounting is complete. In this way, the multi-pole switching device 1 therefore also prevents insufficient or incorrect contacting of devices to the multi-pole switching device 1. If at least one contact line is mounted incorrectly, it is no longer possible to switch on the multi-pole switching device 1 as a whole. Therefore, the multi-pole switching device 1 can only be brought into the on state when all of the spring-type terminals 42-*i* are properly closed.

In the embodiments shown in FIG. 1 to 17, the switching device 1 has a tilt lever as the operating unit 2. Alternatively, a rotary drive may also be provided as the operating unit 2.

When a component is laid in or inserted, a required contact force can be produced by means of a compression spring mounted under the base contact of the receiving unit 4-*i*. Only when the fuse holders or drawer 4-*i* are properly restricted can the switching mechanism move into the on position by means of the tilt lever 2.

In the embodiments shown in FIG. 1 to 17, spring-type terminals 42-*i* are used for contacting the connected devices. In one possible embodiment, the front cover 3 consists of a plastics material. In one possible variant embodiment, the front cover 3 is made of a transparent plastics material.

Figure 19:
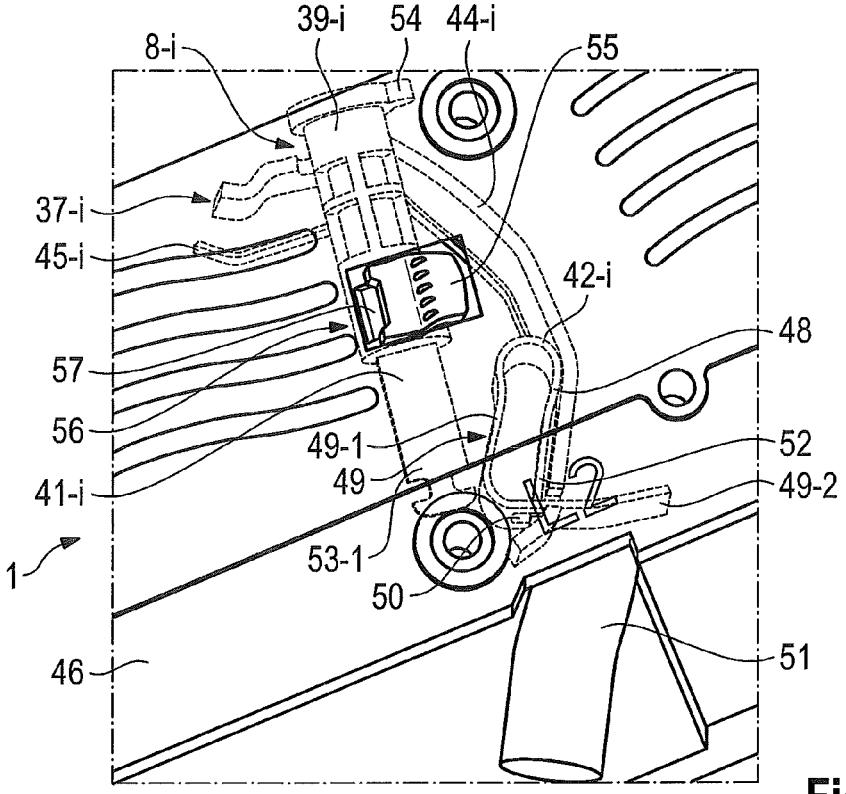
FIG. 19 is a detailed view of a spring-type terminal arranged inside a switching device and the drive thereof in accordance with a second embodiment, the spring-type terminal being open.

Further, FIG. 19 is a detailed view of a connection device 1 comprising a spring-type terminal 42-*i* arranged therein and the mechanical drive 8-*i* thereof in accordance with a second embodiment.

In this context, the connection device 1 is for example in the form of a switching device which is of substantially the same construction as the switching device, which was disclosed above by way of embodiments with reference to FIG. 1-17, 18A and 18B.

The mechanical drive 8-*i* of the spring-type terminal 42-*i* in accordance with the second embodiment differs from the drive shown previously, for example in FIGS. 1-4, 13-13C, 14A-14C and 15-17, of the spring-type terminal 42-*i* of the first embodiment, in that the mechanical drive 8-*i*, rather than being able to be actuated from the upper side of the switching device, can additionally or alternatively be actuated from the side or sideways. This is described in greater detail in the following.

As is shown in the embodiment of FIG. 19, a housing 46 of the connection device 1, in this case of the switching device, comprises a corresponding additional opening 47, through which the mechanical drive 8-1 is accessible as described in greater detail in the following, for actuating the mechanical drive sideways, so as to be able to actuate the spring-type terminal 42-*i* from the side by means of the mechanical drive 8-1.

The spring-type terminal 42-*i* and the mechanical drive 8-*i* thereof can be provided in any type of connection device, for connecting or gripping in place an electrical conductor by means of the spring-type terminal. The embodiments shown in FIGS. 1-17, 18A and 18B of the switching device 1, and the switching device shown in FIG. 19 and the following FIG. 23-26, are merely examples of connection devices 1 according to the invention comprising at least one or more spring-type terminals 42-*i* and the mechanical drives 8-*i* thereof. However, the invention is not limited to a switching device for a busbar system as a connection device 1. In principle, the connection device comprising the at least one spring-type terminal 42-*i* and the mechanical drive 8-*i* thereof may be any type of connection device which is provided for or suitable for connecting an electrical conductor by means of the spring-type terminal 42-*i*.

The spring-type terminal 42-*i* comprises a support leg 48 and a biased spring leg 49. The spring leg 49 comprises an insertion opening 50 for inserting the electrical conductor 51. To insert the electrical conductor 51 into the insertion opening of the spring leg 49, the spring-type terminal 42-*i* is pressed towards the support leg 48 by the mechanical drive 8-*i* so as to be able to insert the electrical conductor 51 into the insertion opening 50. In this context, the spring-type terminal 42-*i* is moved by the mechanical drive 8-*i* from a closed position, in which no electrical conductor 51 is or can be inserted into the insertion opening, into an open position, in which an electrical conductor is inserted into the insertion opening 50 of the spring-type terminal 42-*i* and can be gripped in place by the spring-type terminal. The electrical conductor 51 is gripped against a connection contact 37-*i* by means of the spring-type terminal 42-*i*.

In the embodiment shown in FIG. 19 of the spring-type terminal 42-*i*, the end 52 of the support leg 48 is optionally additionally received and guided in the insertion opening 50 of the spring leg 49. As a result, it can additionally be ensured that the spring leg 49 and the support leg 48 do no undesirably rotate laterally against one another. Further, the spring leg 49 can additionally be guided if it is moved between the open position and the closed position of the spring-type terminal 42-*i*. In principle, the end 52 of the support leg 48 may also be positioned freely and accordingly not be received (not shown) in the insertion opening 50.

As is shown in the embodiment in FIG. 19, the spring leg 49 comprises a first spring leg portion 49-1 and a second spring leg portion 49-2. The first spring leg portion 49-1 is connected to the support leg 48. The second spring leg portion 49-2 in turn comprises the insertion opening 50 and is angled away from the first spring limb portion 49-1 towards the support leg 48. As disclosed above, the end 52 of the support leg 48 may optionally additionally be received and guided in the insertion opening 50 of the second spring leg portion 49-2.

The support leg 48 is formed in such a way that it is positioned on a connection contact or output contact 37-*i*, it being possible to press the spring leg 49 through the mechanical drive 8-*i* to the support leg 48 and to provide an electrical connection between the electrical conductor 51 gripped in the spring-type terminal 42-*i* and an electrical means, for example an electrical fuse, connected to the connection contact 37-*i*.

In the embodiment shown in FIG. 19, the support leg 48 is for example positioned on an output contact 37-*i*. As shown previously for example in FIGS. 3, 4, 15, 16 and 17, the output contact 37-*i* is for example formed by two current brackets 44-*i*, 45-*i*. The lower current bracket 45-*i* or web ensures that when the switching device 1 is switched on the electrical contact between the output contact and the electrical means in the receiving unit or drawer 4-*i* is not interrupted.

The mechanical drive 8-*i* shown in FIG. 19 for driving or actuating the associated spring-type terminal 42-*i* in accordance with the second embodiment, like the mechanical drive disclosed above by way of FIGS. 1-4, 13A-13C, 14A-14C and 15-17 of the spring-type terminal in accordance with the first embodiment, comprises a drive element 39-*i* and a blade 41-*i*. The blade 41-*i* has a broad face 53-1 and a narrow face 53-2 for actuating the spring-type terminal 42-*i*.

The blade 41-*i* is arranged on one end of the drive element 39-*i*, and can be rotated by means of the drive element 39-*i* to open and close the spring-type terminal 42-*i*.

In the embodiment shown in FIG. 19, the spring type terminal 42 is open for introducing the electrical conductor 51 into the insertion opening 50 of the second spring leg portion 49-2. The blade 41-*i* is rotated by means of the drive element 39-*i* into the open position, in which the conductor 51 can be inserted into the insertion opening 50 of the second spring leg portion 49-2. The blade is rotated such a distance that the broad face 53-1 thereof presses the first spring leg portion 49-1 against the support leg 48 and the insertion opening 50 of the second spring leg portion 49-2 is exposed for inserting the electrical conductor 51.

In one possible embodiment, the configuration of the mechanical drive 8-1 for the spring-type terminal 42-1 makes possible a rotation of for example up to 90° or up to 95°.

Optionally, using at least one additional knob 54, it can be ensured that the open spring-type terminal 42-*i* remains in a stable position. Unintentional closing of the spring-type terminal 42-*i* is thus prevented. The knob 54 in the embodiment in FIG. 19 is arranged on the periphery of the drive element 39-*i*.

To actuate or rotate the spring-type terminal 42-*i* sideways in the peripheral direction, the drive element 39-*i* comprises a projection 55 or bulge on the periphery thereof.

By pressing the projection 55, for example using a finger or thumb, the drive element 39-*i* and the blade 41-*i* connected thereto are rotated and the spring-type terminal 42-*i* is rotated from the closed position into the open position or conversely from the open position into the closed position. Once the broad side of the blade 41-*i* has been rotated away from the spring leg 49, the spring leg 49 can spring back into an initial position in which the spring-type terminal 42-*i* is closed. The spring-type terminal 42-*i* can thus snap from the open position thereof into the closed position and thus grip in place the electrical conductor 51 inserted into the insertion opening 50.

In the embodiment shown in FIG. 19, the projection 55 is formed on a first end of an actuation rocker 56 of the drive element 39-*i*. the actuation rocker 56 is provided on the periphery of the drive element 39-*i* and positioned to be tiltable in the peripheral direction on the drive element 39-*i*. By tilting back and forth, the actuation rocker 56 not only makes it possible for the mechanical drive 8-1 to rotate in a peripheral direction, but also makes it possible for the mechanical drive 8-*i* and the blade 41-*i* thereof to rotate back and forth correspondingly. For this purpose, on a first end the actuation rocker 56 comprises the projection 55, which, when it is pressed against, rotates the mechanical drive 8-1 and the blade 41-*i* thereof forwards in the peripheral direction.

On a second, opposite end, the actuation rocker 56 optionally comprises a depression 57, in which a tool, such as a screwdriver, can be received. By means of the screwdriver received in the depression 57, the actuation rocker 56 and the mechanical drive 8-*i* connected thereto can be rotated back again in the peripheral direction.

As disclosed above, the housing 46 of the connection device, in particular of the switching device 1, comprises a corresponding lateral housing opening 47 for actuating the actuation rocker 56 of the mechanical drive 8-*i*. The actuation rocker 56 preferably projects out of the housing sideways through the opening 47 for actuation, in such a way that it can be pressed easily from the outside by an assembler, and particularly preferably the projection 55 can be pressed manually without an additional tool, such as a screwdriver etc.

In one embodiment, the housing 46 of the switching device 1 may, as shown in the following FIG. 26, be formed with a cavity-shaped depression 58 in which the opening 47 is provided, in such a way that the actuation rocker 56 protrudes out of the opening 46 but for example does not protrude past the width of the housing of the switching device 1. The cavity-shaped depression 58 is preferably formed in such a way that it makes possible manual actuation of the projection 55 of the actuation rocker 56, in particular using a finger or thumb.

In the embodiment of FIG. 19, the drive element 39-*i* of the mechanical drive 8-*i*, in particular the drive element 39-*i* of the first embodiment, is additionally provided with a tool recess, such as a slit 40-*i*, for applying a screwdriver and/or an actuation element for actuating the drive 8-*i*. In the following FIG. 20, the actuation element 59 is indicated by a dotted line and in the form for example of a handle, in particular a rotary handle.

If a screwdriver received in the tool recess or slit 40-*i* is rotated or the handle 59 is rotate, the drive element 39-*i* and the blade 41-*i* connected thereto are rotated to move the spring-type terminal 42-*i* between the open position, in which an electrical conductor 51 can be inserted into the insertion opening 50 of the spring-type terminal 42-*i*, and the closed position, in which the electrical conductor 51 can be gripped in place in the spring-type terminal.

Figure 20:
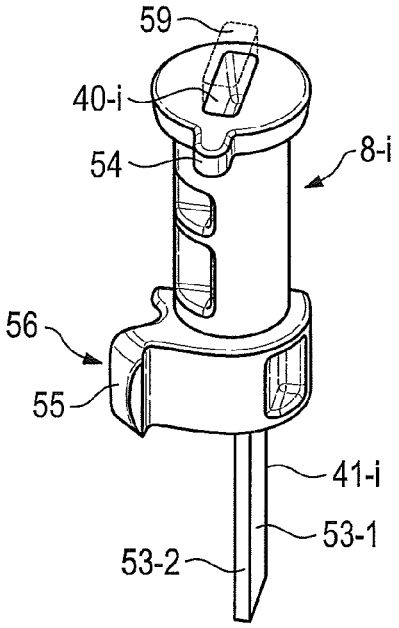
FIG. 20 is a perspective view of the drive of the spring-type terminal of FIG. 19.

FIG. 20 is a perspective view of the drive 8-*i* of the spring-type terminal 42-*i* of FIG. 19.

The mechanical drive 8-*i* comprises the drive element 39-*i*. The blade 41-*i* is provided at one end of the drive element 39-*i* and the slit for applying a screwdriver so as to rotate the drive 8-*i* is provided on the other end. In addition or as an alternative to the slit 40-*i*, in one embodiment of the drive element 39-*i* the actuation element 59 may be provided for actuating the drive 8-*i*. The actuation element 59 is indicated in FIG. 20 by a dotted line and in the form for example of a handle, in particular a rotary handle.

As disclosed above, the blade 41-*i* has a broad face 53-1 and a narrow face 53-2 for actuating the spring-type terminal 42-*i*.

Further, the actuation rocker 56 is formed on the periphery of the drive element 39-*i* for actuating or rotating the mechanical drive 8-*i* sideways in the peripheral direction.

In the embodiment shown in FIG. 20, the drive element 39-*i* and the blade 41-*i* are formed as two parts and the blade 41-*i* is fixed to the drive element 39-*i*. In this context, the blade 41-*i* is for example a metal blade and the drive element 39-*i* is for example a plastic material part, for example a plastics material injection-moulded part.

For fastening, the blade 41-*i* is for example pressed into a clearance or slit in the drive element 39-*i* or formed integrally in the drive element 39-*i*, for example by injection-moulding. However, the invention is not limited to the stated examples for fastening the blade 41-*i* to the drive element 39-*i*, but any other suitable fastening of the blade 41-*i* to the drive element 39-*i* may be provided.

The drive element 39-*i* and the blade 41-*i* may likewise be formed in a single part (not shown), for example made of plastics material, metal, cast metal etc.

The actuation rocker 56 is likewise formed in one piece with the drive element 39-*i*, for example as an injection-moulded part. In one embodiment, the actuation rocker 56 or else merely the projection 55 of the actuation rocker 56 may also be formed fastened to the drive element 39-*i* as a separate part.

Further, the drive element 39-*i* may, as stated previously, comprise at least one knob 54, which ensures that the open spring-type terminal 42-*i* remains in a stable position. For example, the knob 54 is positioned and formed on the drive element 39-*i* of the mechanical drive 8-*i* in such a way that, when the drive 8-*i* opens the spring-type terminal sufficiently to insert an electrical conductor into the insertion opening, the knob is suitably brought into contact with the housing 46, so as to hold the mechanical drive 8-*i* in the open position of the spring-type terminal. For example, frictional contact or gripping contact may be provided between the knob 54 and the housing 56, and means that the knob 54 of the mechanical drive 8-*i* is held in position in the housing and said drive cannot continue to rotate.

In this way, the mechanical drive 8-*i* need not be held by an assembler or installer, for example by means of a screwdriver, in a position in which the spring-type terminal 42-*i* is open. Instead, the mechanical drive 8-*i* can be held in this position in the housing 46 of its own accord by means of the at least one knob 54 thereof. This prevents unintentional closing of the spring-type terminal 42-*i*. The connection of the knob of the mechanical drive to the housing 46 can be released again, for example by actuating the actuation rocker 56 or by inserting a screwdriver into the slit 41 of the drive element 39-*i*.

In the open position of the spring-type terminal 42-*i*, in one embodiment the drive element 39-*i* can for example additionally be overwound, and held in the open position in the housing 46 of the switching device by the knob 54, as disclosed above, until the drive 8-*i* is rotated back into the closed position of the spring-type terminal 42-*i* again.

In one embodiment, the drive element 39-*i* may optionally comprise an additional recess (not shown), in particular or receiving a journal (journal 43-*i* in FIGS. 13A and 14A) of a movable front cover of the switching device. The journal of the movable front cover travels into the recess of the drive element 39-*i* when an operating unit is actuated to switch on the switching device 1, and so the switching device 1 can become switched on.

Conversely, if the spring-type terminal 42-*i* is open, as was shown previously in FIG. 19, the journal of the movable front cover cannot travel into the recess of the drive element 39-*i* when the operating unit is actuated to switch on the switching device 1, and so the switching device 1 is blocked from switching on and the switching device remains switched off. If an assembler accidentally forgets to close a spring-type terminal of a connected device, the switching device 1 is blocked from switching on. Only when the assembler has closed the corresponding spring-type terminal 42-*i*, and the mounting of the device is thus properly completed, can the switching device 1 be switched on.

Figure 21:
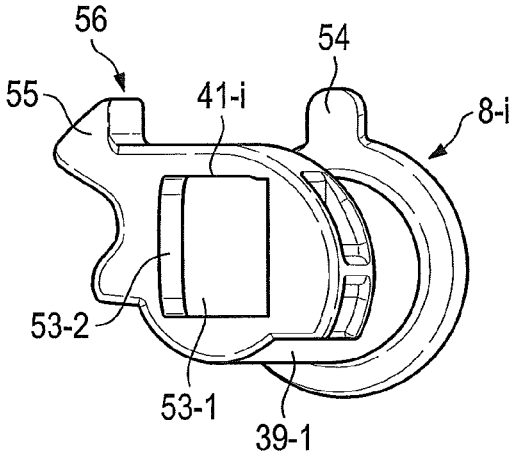
FIG. 21 is a further perspective view of the drive of the spring-type terminal of FIG. 19.

FIG. 21 is a further perspective view of the mechanical drive 8-*i* of FIG. 19. The drive 8-*i* is shown from the side on which the blade 41-*i* is fixed to the drive element 39-*i*. As disclosed above, the drive element 39-*i* comprises the actuation rocker 56 having the projection 55 on the periphery, for rotating the drive element 39-*i* and the blade 41-*i* connected thereto in the peripheral direction when the actuation rocker 56 is pressed manually. As disclosed above, the blade 41-*i* has a broad face 53-1 and a narrow face 53-*i*.

Further, the drive element 39-*i* optionally comprises the at least one additional knob 54.

Figure 22:
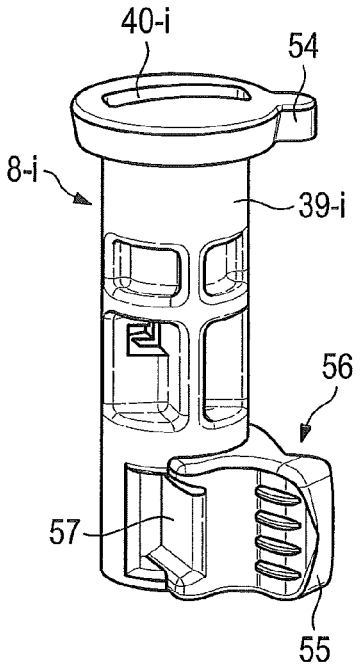
FIG. 22 is a perspective view of the drive element of the drive of FIGS. 20 and 21.

FIG. 22 is a further perspective view of the mechanical drive element 8-*i* of FIG. 19-21. As well as the slit 40-*i* and the knob 54, the actuation rocker 56 for rotating the drive element 39-*i* in the peripheral direction is shown. In this context, on one end the actuation rocker 56 comprises a projection 55, which, when it is pressed against, rotates the mechanical drive 8-1 and the blade 41-*i* thereof forwards in the peripheral direction.

On the other end, the actuation rocker 56 comprises the depression 57, in which for example a screwdriver can be received. By means of the screwdriver inserted into the depression 57, the actuation rocker 56 and the drive 8-*i* connected thereto can be rotated back again.

Figure 23:
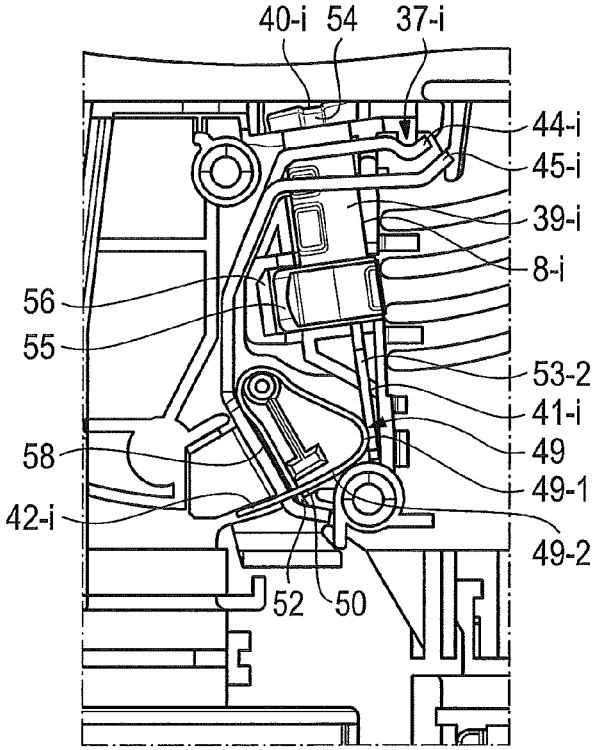
FIG. 23 is a further detailed view of a spring-type terminal arranged inside a switching device and the drive thereof in accordance with the second embodiment, the spring-type terminal being closed.
Figure 24:
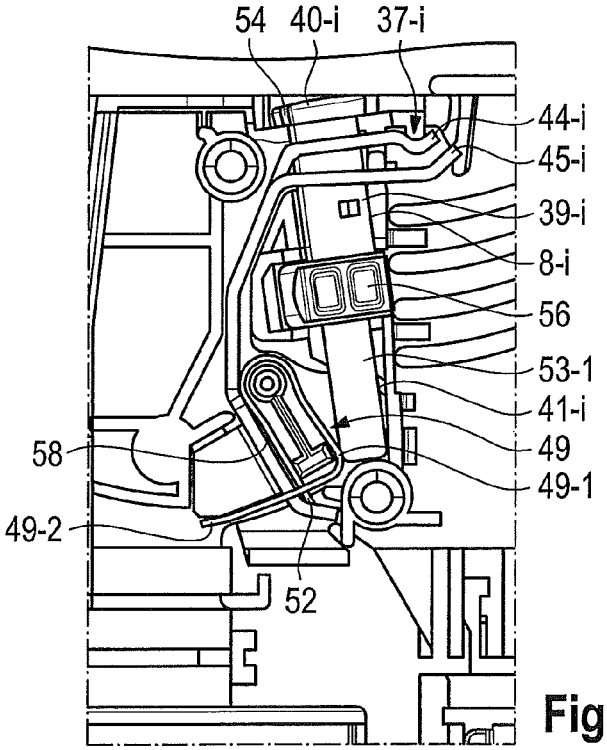
FIG. 24 is the detailed view of FIG. 23 but with the spring-type terminal open.
Figure 25:
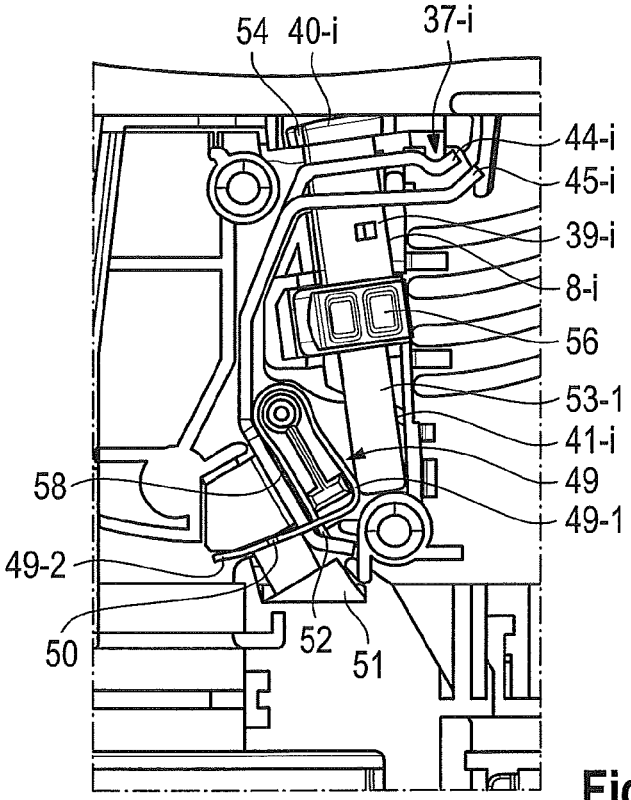
FIG. 25 is the detailed view of FIG. 24 but with a contacting conductor introduced into the open spring-type terminal.

FIG. 23 to 25 are details of a spring-type terminal 42-*i*, arranged inside a switching device 1, and the drive 8-*i* thereof in accordance with the second embodiment, in various positions.

In this context, FIG. 23 shows the spring-type terminal close, it not being possible to insert an electrical conductor into the insertion opening 50 of the second spring leg portion 49-2 of the spring-type terminal 42-*i*. FIGS. 24 and 25 in turn show the spring-type terminal open, an electrical conductor 51 having been inserted into the insertion opening 50 of the spring-type terminal 42-*i* in FIG. 25.

The mechanical drive 8-*i* of the spring-type terminal 8-*i* corresponds to the drive shown in FIG. 19 to 22. Accordingly, the mechanical drive 8-*i* comprises the drive element 39-*i*, which is provided at one end with the slit 40-*i* for inserting a tool, such as a screwdriver, which can be actuated to rotate the mechanical drive 8-1 and the blade 41-*i* thereof in the peripheral direction.

The actuation rocker 56 is further formed on the periphery of the drive element 39-*i*, and can be actuated for actuating or rotating the drive 8-*i* and the blade 41-*i* in the peripheral direction sideways.

When the spring-type terminal is closed, as shown in FIG. 23, the support leg 48 blocks the insertion opening 50 of the spring leg 49 or the second spring leg portion 49-2 thereof, in such a way that it is not possible to insert an electrical conductor into the insertion opening 50. In one embodiment, the broad face 53-1 of the blade 41-*i* of the mechanical drive 8-*i* may be positioned against the spring leg 49 of the spring-type terminal 42-*i*, as is shown in FIG. 23. Optionally, the mechanical drive 8-1 may additionally bias the spring leg 49, but the bias is not sufficient to press the spring leg 49 far enough towards the support leg 48 that it exposes the insertion opening 50 for inserting an electrical conductor.

As is shown in FIG. 24, for opening the spring-type terminal 42-*i* and for inserting an electrical conductor into the insertion opening 50 the mechanical drive 8-*i* is rotated at least until the blade 41-*i* thereof presses the spring leg 49 sufficiently against the support leg 48 to expose the insertion opening 50. For this purpose, the broad face 53-1 of the blade 41-*i* is rotated towards and brought into contact with the spring leg 49. The broad face 53-1 of the blade 41-*i* presses against the first spring leg portion 49-1 of the spring leg 49 and presses it far enough towards the support leg 48 that it exposes the insertion opening 50 of the second spring leg portion 49-2, in such a way that a conductor can be inserted, as is shown in FIG. 25. The blade 41-*i* may for example consist of steel.

The spring-type terminal 42-*i* can be opened by rotating the drive 8-*i* and the blade 41-*i* thereof from above or from the upper end of the drive 8-*i* by means of a screwdriver, which is inserted into the slit 40-*i* of the drive element and rotated.

Likewise, the spring-type terminal 42-*i* can also be opened, in that the actuation rocker 56 actuates the switching device from the side of the housing 46 and the mechanical drive 8-1 together with the blade 8-*i* thereof is thus rotated in the peripheral direction. For this purpose, in the embodiment in FIG. 23-25, the projection 55 of the actuation rocker 56 is pressed on the side of the housing 46 of the switching device 1. As a result, an electrical conductor can be inserted into the insertion opening 50 of the open spring-type terminal 42-*i* from below particularly easily, as is shown in FIG. 25, without an additional tool being need during the installation of the electrical conductor.

By means of the at least one additional knob 54, it can be ensured that the open spring-type terminal 42-*i* remains in a stable position.

The spring-type terminal 42-*i* can subsequently be closed by rotating the slit 40-*i* at the upper end of the drive element 39-*i* by means of a screwdriver. Likewise, the spring-type terminal 42-*i* may also be closed by actuating the actuation rocker 56, in that a screwdriver is inserted into the depression 57 of the actuation rocker 56 and moves or tilts it back.

If the spring-type terminal 42-*i* is closed, the spring-type terminal 42-*i* grips the output contact 37-*i* between the support leg 48 thereof and the electrical conductor 51 received in the insertion opening 50.

Figure 26:
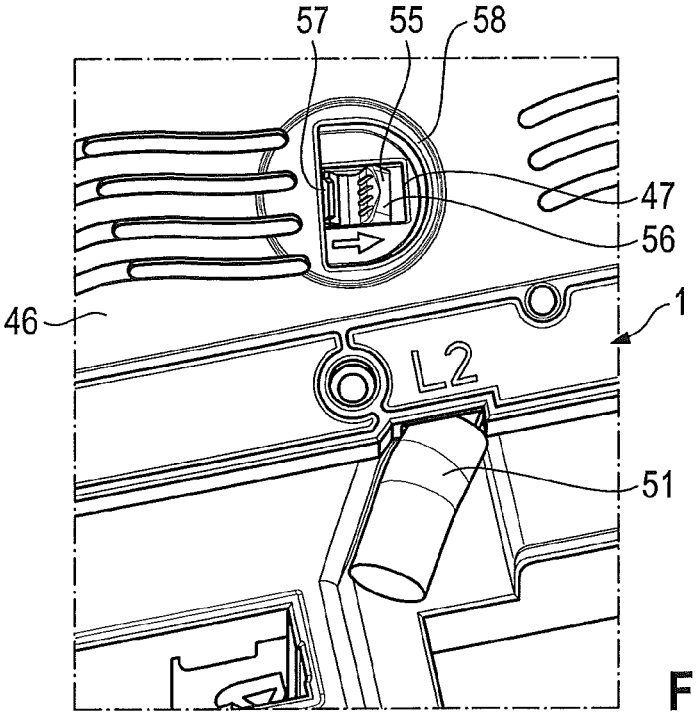
FIG. 26 is a detailed view of the switching device and the spring-type terminal according to the invention arranged there in and the drive thereof from the outside.

FIG. 26 is a detailed view of a switching device 1 comprising a spring-type terminal 42-*i* and the drive 8-*i* thereof in accordance with FIG. 23 to 25. In this context, an electrical conductor 51 is inserted into the housing of the switching device 1 from below and connected to the spring-type terminal 42-*i* to connect an electrical device to an electrical means in the switching device 1, for example an electrical fuse received in the receiving unit of the switching device.

As is shown in FIG. 26, the housing 46 comprises a lateral opening 47 for actuating the actuation rocker 56 of the drive 8-*i*. At least the projection 55 of the actuation rocker 56 protrudes sideways out of the opening 47 of the housing 46 for actuation, in such a way that the projection 55 can easily be actuated from the outside by an assembler without an additional tool, such as a screwdriver etc.

In one embodiment, the housing 46 comprises a cavity-shaped depression 58, in which the opening 47 for the actuation rocker 56 is provided. The cavity-shaped depression 58 is formed in such a way that the projection 55 of the actuation rocker 56 protrudes out of the opening 47 in a manner suitable for actuation, but does not protrude beyond the width of the housing of the switching device 1. The cavity-shaped depression 58 preferably makes it possible to actuate the actuation rocker 56 manually by pressing the projection 55 of the actuation rocker 56.

In the embodiment shown in FIG. 26, the actuation rocker 56 can moreover be moved back in that a tool, such as a screwdriver, is inserted into the recess 57 of the actuation rocker 56 and rotates or tilts it back in the peripheral direction of the drive 8-*i*. In the embodiments disclosed above with reference to FIG. 19 to 26, to connect an electrical conductor 51 the respective spring-type terminal 42-*i* is opened. For this purpose, in FIG. 19 to 26, a suitable tool is inserted into a slit 40-*i* on the upper or free end of the mechanical drive 8-*i*, from the upper side of the housing 46 of the connection device 1, and drive 8-*i* is rotated until the spring-type terminal 42-*i* is in the open position thereof. Subsequently, the electrical conductor 51 is inserted into the insertion opening 50 of the spring-type terminal 42-*i*. However, the line insertion of the electrical conductor 51 into the open spring-type terminal 42-*i* takes place from the opposite side or underside of the housing 46. Thus, the spring-type terminal 42-*i* is opened and the electrical conductor 51 inserted into the open spring-type terminal 42-*i* from two different sides of the hosing 46, positioned opposite one another.

So as additionally to simplify connecting the electrical conductor 51, in the second embodiment the drive element 39-*i* comprises the additional projection 55 or the additional actuation rocker 56 having the projection 55 at the side. The projection 55 or the actuation rocker 56 having the projection 55 can be actuated easily from the side to open or close the spring-type terminal 42-*i*. This can further simplify connecting an electrical conductor 51 by means of the spring-type terminal 42-*i*.

As disclosed above, this projection 55 protrudes out of the housing 46 sideways through the associated housing opening 47. So that the projection 55 does not for example undesirably protrude beyond the width of the housing 46, the cavity-shaped, depressed contour is preferably formed in the hosing wall. By means of said contour, the projection 55 can be operated easily without a tool and pressed by an assembler using a finger or thumb.

This reduces the wiring complexity to an absolute minimum. In this way, the spring-type terminal or the spring leg thereof can be biased ex works, in other words the product is delivered with the terminals already opened.

For example, the installer merely inserts the electrical lines into the open spring-type terminals 42-*i* and grips them by actuating the actuation rocker 56 using a thumb or a tool and thus closes the spring-type terminal 42-*i*.

The embodiments shown in FIG. 19 to 26 of the spring-type terminal 42-*i* and the mechanical drive 8-*i* thereof have the advantage that actuating the projection 55 to rotate the mechanical drive 8-*i* in a direction, for example for opening or closing the spring-type terminal 42-*i* does not require an additional tool, such as a screwdriver. As a result, no additional tool is required during the installation of an electrical conductor 51. Moreover, reliable mounting is possible, since there is no uncertainty for an installer as to the direction of rotation of the mechanical drive 8-*i*. Further, the spring-type terminal 42-*i* can snap back automatically after an electrical conductor 51 is inserted into the insertion opening 50 thereof, without an additional exertion of force being required for this purpose. Once the spring leg 49 is no longer being pushed against the support leg 48 by the broad face 53-1 of the blade 41-*i* of the mechanical drive 8-*i*, the spring leg 49 can automatically spring back towards the initial position thereof.

The embodiments disclosed above with reference to FIG. 1-26 of the spring-type terminal 42-*i* and the mechanical drive 8-*i* thereof can be used in switching devices, in particular multi-pole switching devices, or other connection devices 1 in which electrical conductors 51 are to be connected. By means of the spring-type terminal 42-*i*, the electrical conductors 51 can be connected for example to electrical means in the connection device, such as circuit breakers, fuse elements, fuse holders, safety switches such as FI safety switches, etc.

For example, by means of the connection device 1 a the at least one spring-type terminal 42-*i* thereof and the mechanical drive 8-*i* thereof, electrical conductors having a cross-section in a range of 1.5 $mm^2$ and 16 $mm^2$ can be connected. However, the invention is not limited to this range.

As was disclosed previously with reference to FIG. 1-26, a spring-type terminal 42-*i* comprising a mechanical drive 8-*i* is provided for actuating the spring-type terminal 42-*i* so as to move it into an open position in which an electrical conductor 51 can be inserted into the insertion opening 50 of the spring-type terminal 42-*i* and a closed position in which an electrical conductor 51 inserted into the insertion opening 50 is gripped in the spring-type terminal.

In this context, in particular a conventional spring-type terminal may be used as the spring-type terminal and actuated by means of the mechanical drive 8-*i*.

Further, as was disclosed previously by way of example with reference to FIG. 1-26, a mechanical drive 8-*i* may be provided for actuating the spring-type terminal 42-*i*, in particular including for actuating conventional spring-type terminals.

LIST OF REFERENCE NUMERALS

1 Connection device
8-*i* Drive
37-*i* Output contact
39-*i* Drive element
40-*i* Slit
41-*i* Blade
42-*i* Spring-type terminal
43-*i* Journal (in FIGS. 13A and 14A for travelling into a recess in the drive)
44-*i* Current bracket
45-*i* Current bracket
46 Housing
47 Housing opening
48 Support leg
49 Spring leg
49-1 First spring leg portion
49-2 Second spring leg portion
50 Insertion opening
51 Electrical conductor
52 End of the support leg
53-1 Broad face of the blade
53-2 Narrow face of the blade
54 Knob
55 Projection
56 Actuation rocker
57 Depression
58 Cavity-shaped depression (in the housing)
59 Handle

The invention claimed is:

1. A connection device for connecting at least one electrical conductor to at least one spring-type terminal which is provided in a housing of the connection device and which comprises a mechanical drive, wherein the mechanical drive is arranged or installed in the housing and includes a blade which has a broad face and a narrow face for actuating the spring-type terminal, wherein the broad face of the blade moves the spring-type terminal into an open position in which the electrical conductor can be inserted into an insertion opening of the spring-type terminal, wherein at least one projection is formed on the mechanical drive, and protrudes through a housing opening of the housing to actuate the mechanical drive, wherein the projection is formed on the periphery of the mechanical drive and wherein the mechanical drive is rotated to open and close the spring-type terminal by pressing the projection.

2. The connection device according to claim 1, wherein the narrow face of the blade makes it possible to move the spring-type terminal into a closed position in which the electrical conductor is gripped in place in the spring-type terminal.

3. The connection device according to claim 1, wherein the spring-type terminal comprises a support leg and a spring leg, which has an introduction opening for introducing the electrical conductor and is pressed towards the supporting leg by the broad face of the blade of the mechanical drive so as to grip the introduced electrical conductor in place.

4. The connection device according to claim 3, wherein the spring leg of the spring-type terminal is sprung back into a closed position in which the electrical conductor is gripped in the spring-type terminal when the narrow face of the blade is in contact with the spring leg.

5. The connection device according to claim 1, wherein the mechanical drive comprises a tool seat on one end, in particular a slit, for receiving a tool and actuating the spring-type terminal by means of the mechanical drive.

6. The connection device according to claim 1, wherein the mechanical drive comprises an actuation element on one end, in particular a handle or lever, for actuating the spring-type terminal by means of the mechanical drive.

7. The connection device according to claim 1, wherein the projection is provided on a first end of an actuation rocker, a depression for introducing a tool, in particular a screwdriver, being provided on the opposite, second end of the actuation rocker.

8. The connection device according to claim 1, wherein the mechanical drive comprises at least one knob, by means of which the mechanical drive can be fixed in a predetermined position in the housing, the spring-type terminal preferably being in the open position thereof in the predetermined position.

9. The connection device according to claim 1, wherein the mechanical drive comprises a drive element having a first and a second end, the blade being provided on the first end.

10. The connection device according to claim 9, wherein the blade of the mechanical drive is pressed into a slit in the drive element or formed integrally in the drive element, in particular by injection-moulding.

11. The connection device according to claim 1, wherein the mechanical drive is installed in the housing of the connection device so as to be rotatable in the peripheral direction.

12. The connection device according to claim 1, wherein the housing comprises a cavity-shaped depression in which the housing opening is provided.

13. A method for connecting at least one electrical conductor in a connection device according to claim 1, comprising the steps of:

moving the spring-type terminal into an open position by way of the mechanical drive;

inserting the electrical conductor into an insertion opening of the spring-type terminal; and moving the spring-type terminal, by means of the mechanical drive from the open position thereof into a closed position in which the electrical conductor inserted into the insertion opening is gripped in place in the spring-type terminal.

14. The connection device according to claim 2, wherein the spring-type terminal comprises a support leg and a spring leg, which has an introduction opening for introducing the electrical conductor and is pressed towards the supporting leg by the broad face of the blade of the mechanical drive so as to grip the introduced electrical conductor in place.

* * * * *